US006325674B1

(12) United States Patent
Oliphant et al.

(10) Patent No.: US 6,325,674 B1
(45) Date of Patent: Dec. 4, 2001

(54) CARD EDGE CONNECTOR FOR A MODULAR JACK

(75) Inventors: David Oliphant, Salt Lake City; Thomas A. Johnson, Draper, both of UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/528,501

(22) Filed: Mar. 20, 2000

(51) Int. Cl.[7] ..... H01R 24/00
(52) U.S. Cl. ..... 439/676; 439/329; 439/923
(58) Field of Search ..... 439/676, 354, 439/344, 946, 923, 329, 630

(56) References Cited

U.S. PATENT DOCUMENTS

| | | | | |
|---|---|---|---|---|
| 2,916,720 | | 12/1959 | Steans | 339/91 |
| 3,205,471 | | 9/1965 | Herrmann | 339/176 |
| 4,186,988 | | 2/1980 | Kobler | 339/176 |
| 4,239,316 | * | 12/1980 | Spaulding | 439/676 |
| 4,241,974 | | 12/1980 | Hardesty | 339/154 |
| 4,303,296 | | 12/1981 | Spaulding | 339/122 |
| 4,352,492 | | 10/1982 | Smith | 271/1 |
| 4,407,559 | | 10/1983 | Meyer | 339/126 |
| 4,428,636 | | 1/1984 | Kam et al. | 339/97 |
| 4,566,749 | | 1/1986 | Johnston | 339/95 D |
| 4,602,842 | | 7/1986 | Free et al. | 339/156 R |
| 4,647,136 | | 3/1987 | Kinoshita et al. | 339/125 R |
| 4,710,136 | | 12/1987 | Suzuki | 439/374 |
| 4,778,410 | | 10/1988 | Tanaka | 439/676 |
| 4,875,872 | | 10/1989 | Tanaka | 439/344 |
| 4,915,648 | | 4/1990 | Takase et al. | 439/490 |
| 4,934,947 | * | 6/1990 | Brummans et al. | 439/77 |
| 5,035,641 | | 7/1991 | Van-Santbrink et al. | 439/329 |
| 5,051,099 | | 9/1991 | Pickles et al. | 439/108 |
| 5,139,439 | | 8/1992 | Shie | 439/359 |
| 5,183,404 | | 2/1993 | Aldous et al. | 439/55 |
| 5,184,282 | | 2/1993 | Kaneda et al. | 361/395 |

(List continued on next page.)

FOREIGN PATENT DOCUMENTS

| | | |
|---|---|---|
| 61-256850 | 8/1985 | (JP) . |
| WO95/13633 | 5/1995 | (WO) . |

OTHER PUBLICATIONS

U.S. Patent application No. 09/528,500, Oliphant et al., filed Mar. 20, 2000.

U.S. Patent application No. 09/528,331, Oliphant et al., filed Mar. 20, 2000.

P.E. Knight and D.R. Smith, "Electrical Connector for Flat Flexible Cable," IBM Technical Disclosure Bulletin, vol. 25, No. 1, Jun. 1982.

*Primary Examiner*—Brian Sircus
*Assistant Examiner*—Javaid Nasri
(74) *Attorney, Agent, or Firm*—Workman, Nydegger & Seeley

(57) ABSTRACT

A card edge connector allows a modular jack to be electronically connected to a PCMCIA Type III communications card. The card edge connector includes a modular jack with a main body portion having a top surface, a bottom surface, a front surface and a rear surface. A receptacle is disposed entirely within the front surface of the modular jack and the receptacle is sized and configured to receive a RJ series connector plug such that no portion of the plug extends through either the top surface or the bottom surface of the modular jack. A connector attached to the rear surface of the modular jack and the connector includes a socket sized and configured to receive a portion of a printed circuit board disposed within the communications card. Desirably, the card edge connector includes at least one contact pin including a plug engaging portion that extends into the receptacle and a printed circuit board engaging portion that extends into the socket.

23 Claims, 12 Drawing Sheets

U.S. PATENT DOCUMENTS

| | | | |
|---|---|---|---|
| 5,310,360 | 5/1994 | Peterson | 439/571 |
| 5,336,099 | 8/1994 | Aldous et al. | 439/131 |
| 5,338,210 | 8/1994 | Bechmam et al. | 439/131 |
| 5,364,294 | 11/1994 | Hatch et al. | 439/676 |
| 5,391,083 | 2/1995 | Roebuck et al. | 439/76 |
| 5,391,094 | 2/1995 | Kakinoki et al. | 439/638 |
| 5,411,405 | 5/1995 | McDaniels et al. | 439/131 |
| 5,425,660 | 6/1995 | Weikle | 439/676 |
| 5,457,601 | 10/1995 | Georgopulos et al. | 361/686 |
| 5,478,261 | 12/1995 | Bogese, II | 439/676 |
| 5,481,616 | 1/1996 | Freadman | 381/90 |
| 5,499,923 | 3/1996 | Archibald et al. | 439/26 |
| 5,505,633 | 4/1996 | Broadbent | 439/329 |
| 5,509,811 | 4/1996 | Homic | 439/55 |
| 5,538,442 | 7/1996 | Okada | 439/676 |
| 5,547,401 | 8/1996 | Aldous et al. | 439/676 |
| 5,561,727 | 10/1996 | Akita et al. | 385/88 |
| 5,562,504 | 10/1996 | Moshayedi | 439/638 |
| 5,580,274 | 12/1996 | Tsair | 439/571 |
| 5,608,607 | 3/1997 | Dittmer | 361/686 |
| 5,634,802 | 6/1997 | Kerklaan | 439/131 |
| 5,660,568 | 8/1997 | Moshayedi | 439/654 |
| 5,667,390 | 9/1997 | Keng | 439/76.1 |
| 5,679,013 | 10/1997 | Matsunaga et al. | 439/144 |
| 5,697,815 | 12/1997 | Drewnicki | 439/638 |
| 5,727,972 | 3/1998 | Aldous et al. | 439/655 |
| 5,773,332 | 6/1998 | Glad | 439/344 |
| 5,797,771 | 8/1998 | Garside | 439/610 |
| 5,816,832 | 10/1998 | Aldous et al. | 439/131 |
| 5,876,218 | 3/1999 | Liebenow et al. | 439/74 |
| 5,938,480 | 8/1999 | Aldous et al. | 439/676 |
| 5,980,322 | 11/1999 | Madsen et al. | 439/621 |
| 5,984,731 | 11/1999 | Laity | 439/676 |
| 5,989,042 | 11/1999 | Johnson et al. | 439/131 |
| 6,005,774 | 12/1999 | Chiba et al. | 361/737 |
| 6,033,240 | 3/2000 | Goff | 439/131 |
| 6,116,962 | 9/2000 | Laity | 439/676 |
| 6,164,989 * | 6/1998 | Glad et al. | 439/131 |
| 6,217,391 | 4/2001 | Colantuono et al. | 439/676 |

* cited by examiner

CARD EDGE CONNECTOR FOR A MODULAR JACK

BACKGROUND OF THE INVENTION

1. Field of the Invention

The present invention generally relates to connectors used with electronic devices such as computers. More specifically, the present invention relates to connectors used with communications cards that allow computers to be connected to electronic devices and communications systems.

2. Description of Related Art

Portable computers and other electronic equipment frequently use communications cards to allow electrical communication to be established between electronic devices or to allow electronic devices to be connected to communication systems. These communications cards are typically located internally within the computer or electronic equipment and the cards are relatively small in size. The communications cards, for example, are commonly used with modems, fax/modems, Local Area Network (LAN) adaptors and cellular telephone equipment.

Conventional communications cards are often constructed according to the Personal Computer Memory Card International Association (PCMCIA) guidelines, which set forth the physical specifications and electronic architecture of the cards (also known as PC cards). The PCMCIA guidelines define three types of cards and sockets for support of electronic equipment. For instance, PCMCIA standards require all PC cards to have the same length and width (roughly the size of a credit card), and each card includes a connector to allow it to be connected to the computer or other host device. In particular, according to the known PCMCIA standards, PC cards have a length of 85.6 mm (3.4 inches), a width of 54.0 mm (2.1 inches), and a height of 3.3 mm (0.1 inches), 5.0 mm (0.2 inches) or 10.5 mm (0.4 inches) depending upon if the card is a Type I card, Type II card or Type III card, respectively. Type I PC cards are typically used for memory devices such as read only memory (RAM), flash memory or static random access memory (SRAM). Type II PC cards are generally used with input/output (I/O) devices such as data/fax modems, LANs and mass storage devices. Type III PC cards are used for devices whose components are thicker and require additional space. The PCMCIA guidelines also define corresponding types of sockets. Type I sockets support only Type I cards, Type II sockets support Type I and II cards, and Type III sockets support all three types of cards.

A conventional PC card 10 is shown in FIG. 1. The PC card 10 has a generally rectangular shaped body with a top surface 12, a bottom surface 14, a right side 16, a left side 18, a front end 20 and a rear end 22. The terms "front" and "rear" are used in reference to the direction in which the PC card 10 is inserted into the receiving socket. The front end 20 of the PC card 10 includes a 68-pin connector 24 that is used to connect the card to an electronic device such as a notebook or lap top computer. Disposed within the PC card 10 is a printed circuit board or substrate 26 with various electronic components 28 that provides the necessary circuitry to perform the intended functions of the PC card.

Additionally, a variety of connectors have been developed in order to facilitate electrical communication between electronic devices and to allow electronic devices to be connected to communication systems. These conventional connectors typically include a plug and a corresponding jack that is sized and shaped to receive the plug. Thus, when the plug is inserted into the jack, the connector allows electrical communication to be established between the plug and the electronic device.

These conventional connectors are frequently constructed according to standards that are well known in the art to promote compatibility and interchangeability. These standard connectors allow various electronic devices and communication systems to be interconnected or linked as desired by the user. For instance, a conventional electrical connector that is well known in the art is the RJ-xx series of connectors, such as the RJ-11, RJ-12 and RJ-45 connectors. The RJ series of connectors include a plug and a corresponding jack that is sized and configured to receive the plug. The RJ-11 connector, for example, includes four or six contact pins and is commonly used to attach communication devices, such as telephones, facsimile machines and modems to electronic devices. The RJ-45 connector includes eight contact pins and it is frequently used to connect LANs or Ethernets to electronic devices. The RJ series of connectors have the same overall configuration except for slightly different widths. Thus, the RJ-11 and RJ-45 connectors have the same general configuration, but the RJ-45 connector is slightly wider than the RJ-11 connector.

As shown in FIGS. 2 and 3, a conventional RJ series connector 30, such as a RJ-11 connector, includes a jack 32 and a plug 34. The plug 34 includes a rectangular contact pin block 36 with a front end 38, a rear end 40, top surface 42, bottom surface 44, and a plurality of contacts 46 located proximate the front end of the block. The contacts 46 are recessed within tracks formed in the contact pin block 36, and the contacts are accessible from the front end 38 and bottom surface 44 of the block. A cable 48 is used to electrically connect the plug 34 to a communications system or other electronic device. The front end 38 of the contact pin block 36 also includes a pair of notches that define front abutment surfaces 50 that are perpendicular to the top surface 42 of the block.

A biased retention clip 52 extends from the top surface 42 of the contact pin block 36. The biased clip 52 includes a broad base 54 in which the front end is integrally attached to the top surface 42 of the block 36 and the other end includes a narrow tab 56 extending away from the base 54. An abrupt transition between the base 54 and the tab 56 creates a retention edge 58 on each side of the tab 56. The biased clip 52 extends at an angle relative to the top surface 42 of the contact pin block 36 and the biased clip may be elastically deformed towards the top surface of the contact pin block.

As best seen in FIG. 2, the jack 32 includes an aperture 60 that is sized and configured to receive the plug 34. The jack 32 includes a first pair of notches 62 with a first opening 63 disposed between this first pair of notches, and a second pair of notches 64 with a second opening 65 disposed between this second pair of notches. When it is desired to insert the plug 34 into the jack 32, the user depresses the biased clip 52 towards the top surface 42 of the contact pin block 36 and this permits the plug to be inserted into the jack. The user then releases the biased clip 52 after it is inserted into the jack 32 and, as shown in FIG. 3, the biased clip 52 returns to its original position. The plug 34 is securely held within the jack 32 because the retention edges 58 of the biased clip 52 engage the inner surfaces of the second pair of notches 64 and the narrow tab 56 extends through the opening 65 formed between the second pair of notches.

The jack 32 includes a plurality of contact pins 66 that elastically deform or deflect as the plug 34 is inserted into the aperture 60. In greater detail, each contact pin 66 includes a wire with a straight section 68 and a contact section 70 that are joined by a bend 72. As shown in phantom in FIG. 3, the wire is bent at an angle a of at least 120° with respect to the straight section 68 when the plug 34 is not inserted into the receptacle 32. When the plug 34 is inserted into the jack 32, the contact 46 on the plug 34 pushes the contact section 70 of the contact pin 66 downwardly towards the straight section 68 of the contact pin until the contact pin is bent or folded back upon itself at an angle of about 180° . The other end of the contact pin 66 typically extends through a rear wall of the receptacle and it is soldered to an electrical contact on an electronic device such as a printed circuit board or substrate.

The electronic devices used with these conventional RJ series connectors are becoming smaller and smaller. Because these electronic devices are becoming smaller, one or more of the dimensions of the RJ series connector may now be larger than one or more of the dimensions of the electronic device. For example, communications cards that comply with PCMCIA guidelines have a height that is less than the height of conventional RJ series connectors. In particular, communications cards that comply with the PCMCIA standards have a maximum height of 10.5 mm for a Type III PC card, but a conventional RJ-11 jack has a minimum height of at least 12.0 mm. Thus, a conventional RJ-11 jack cannot be mounted in a PC card because the height of the RJ-11 jack exceeds the height limitation of the PC card.

As shown in FIG. 4, a known device to connect an RJ series connector to a PC card includes a physical/electrical connector 80 that is integrally attached to the rear end of a PC card 82. The physical/electrical connector 80 includes a generally rectangular shaped body 84 with a conventional RJ series jack or receptacle 86. Disadvantageously, because the physical/electrical connector 80 extends outwardly from the computer 88, the computer may no longer fit within its carrying case, the protruding connector may be easily broken or damaged, the protruding connector may limit the usefulness of the computer, and the connector alters the aesthetics of the computer.

It is also known to use flexible connectors or adaptors to connect RJ series connectors to a communications card. These known adaptors, however, suffer from several drawbacks such as requiring the user to externally carry the adapter from the computer. Thus, the user must remember to bring the adaptor, otherwise the communications card cannot be used. Disadvantageously, users commonly misplaced or lost such adaptors. In addition, these known adaptors are typically bulky and that exacerbates the problems associated with externally carrying the adaptor. In addition, these known adaptors typically extend well beyond the periphery of the host computer and that limits the usefulness of the adaptor, and often posed problems when used in tight space confinements.

Other known devices have been developed in order to allow conventional RJ series connectors to be used with PC cards. For example, U.S. Pat. Nos. 5,183,404; 5,335,099; 5,338,210; 5,547,401; 5,727,972 and 5,816,832 disclose assorted devices and methods to connect RJ series connectors to PC cards. These patents are assigned to the same assignee as the present application and are hereby incorporated by reference in their entireties. Briefly, the above-listed patents generally disclose a thin plate that is slidably mounted to a PC card. The thin plate includes a top surface with an aperture formed therein and a plurality of contact wires mounted to the thin plate. Each contact wire includes a first end that is freely exposed within the aperture and a second end that is connected to the thin plate. A flexible wire ribbon is typically used to electrically connect the second end of the contact wires to contacts on a printed circuit board located within the PC card.

As known in the art, the thin plate selectively slides between an extended position and a retracted position. In the extended position, the aperture is exposed such that a corresponding plug, such as a RJ-11 plug, can be inserted and contacts on the plug engage the contact wires extending into the aperture. This allows electrical connection to be established between the plug and the printed circuit board. In particular, electrical communication is established between the plug, contact wires, flexible wire ribbon and printed circuit board. When not in use, the thin plate is retracted into the PC card and the aperture is not exposed. The flexible wire ribbon allows the thin plate to be repeatedly moved between the extended and retracted positions because it freely bends or folds as the plate is moved. Another known device for using a RJ series connector with a PC card is disclosed in U.S. Pat. No. 5,773,332 issued to Glad. As shown in FIG. 5, the Glad patent discloses a communications card 90 that follows the PCMCIA card Type III standards for dimensions and configuration. The Type III PC card 90 includes two receptacles 92, 94 that are designed to receive standard RJ-xx plugs (specifically, a RJ-11 plug and a RJ-45 plug). The Type III PC card 90 also includes an upper surface 96 and a lower surface 98 that form a portion of the housing of the communications card. The Glad patent explains that because the height of a PCMCIA Type III card is still not great enough to allow standard RJ-xx series receptacle to be mounted therein, T-shaped cutouts 100 are removed from the housing of the communications card 40. The T-shaped cutouts 100 accommodate the biased clip 102 and the ridge 104 present on the connector plug 106. The shape of the T-shaped cutout 100 engages the biased clip 102 and the ridge 104 to hold the plug 106 in place. The Type III PC card height limitation of 10.5 mm, however, is not satisfied when the plug is inserted into the receptacle because the biased clip 102 extends through the cutout 100 and protrudes through the upper surface 96 of the housing. Disadvantageously, the biased clip 102 can be easily broken or damaged because it protrudes through the upper surface 96 of the card 90. Further, the protruding clip 102 may limit design options and uses of the communications card.

Still another known device for connecting a RJ series connector to a PC card is disclosed in U.S. Pat. No. 5,984,731 issued to Laity. As shown in FIGS. 6 and 7, a plug 110 is inserted into a receptacle 112 located between upper and lower surfaces 114, 116 of a communications card 118. The receptacle 112 includes a cutout 120 to allow the biased clip 122 of the plug 110 to extend through the outer surface of the communications card 118. Specifically, the Laity patent explains that by providing an open bottom in the receptacle, the retention clip, in the fully inserted position of the modular plug is permitted to project outwardly from the lower, horizontal outer surface of the card. Accordingly, the 10.5 mm height of the Type III card can incorporate a receptacle conforming to the FCC RJ connector standards, if the retention clip is permitted to project through the outer surface of the card.

In greater detail, as seen in FIGS. 6 and 7, disposed between the upper and lower surfaces 114, 116 of the communications card 118 are contact wires 124 that include a first end 126 soldered to the upper surface of the printed circuit board 128 and a second end 130 that extends into the receptacle 112. As seen in FIG. 6, the contact wires 124 include a first angled section 132 that is bent at a 180° angle such that the wire is folded back upon itself and a second angled section 134 that is bent at a 90° angle.

The Laity patent discloses a complicated structure with a plurality of components used to connect the plug 110 to the communications card 118. Briefly, the housing of the communications card 118 defines the receptacles 112, and the receptacles are sized and configured to closely receive standard RJ-type modular plugs. A contact block with planar abutment surfaces is engaged by and bonded to the upper surface of the rear margin of the printed circuit board 128. Slots in the wall of the contact block are longitudinally aligned with grooves in the interior surface of the top wall of the receptacle body. The first ends or solder tails 126 of the contact wires 124, which are soldered to the printed circuit board 128, are contained within recesses. After fabrication of the subassembly comprising the contact block and the printed circuit board, the recesses facilitate inspection of the integrity of the solder joints connecting the first ends 126 of the contact wires 124 to the printed circuit board 128 and provide sufficient space to permit resoldering if necessary. Disadvantageously, if the receptacles in the housing are not exactly aligned with the contact block, the slots in the wall of the contact block and the grooves in the inner surface of the receptacle will not be aligned. This undesirably causes the pins to be laterally deformed and may result in the failure of the connector. Additionally, this connector requires hand soldering and that is time consuming, expensive and unreliable. Further, because the contact block is permanently attached to the substrate, this forces the user to dispose of the entire communications card if the connector is broken or damaged. Finally, the biased clip of the plug is more likely to be broken or damaged because it protrudes outwardly through an outer surface of the communications card and it is not contained within the receptacle.

SUMMARY OF THE INVENTION

A need therefore exists for a card edge connector that electrically couples a modular jack to a communications card. Preferably, the communications card conforms to the PCMCIA standards for a Type III communications card and the modular jack is sized and configured to receive standard RJ series plugs.

One aspect of the present invention is a card edge connector that quickly and easily allows a modular jack to be attached to a substrate or circuit board. The modular jack allows the communications card to be interchangeably connected to various electronic devices and communications systems. The modular jack also allows the communications card to be readily connected and disconnected to desired electronic devices and communications systems. This allows the communications card to be used with portable systems or while traveling.

Another aspect is a card edge connector for electrically connecting a modular jack to a Type III PC card. Advantageously, the card edge connector allows the jack to be mounted within the PC card and the PC card conforms to the Type III PCMCIA card height limitation of 10.5 mm. Significantly, when the plug is received within the jack, the plug is enclosed within the receptacle and no portion of the plug extends through either the upper or lower surfaces of the PC card. That is, no portion of the plug protrudes through the upper or lower surfaces of the PC card when the plug is inserted into the jack.

Yet another aspect is a card edge connector that allows a modular jack to be releasably connected to a printed circuit board. This simplifies both the manufacturing of the communications card and repair if the modular jack is worn or damaged. Additionally, because the modular jack is not permanently connected to the printed circuit board by soldering, the card edge connector saves time and costs during the manufacturing process. Further, the connector is relatively inexpensive to construct and assemble because the connector does not contain any complicated structures or movable parts.

Still another aspect is a connector that is electrically connected to only a small portion of the card edge of the printed circuit board. Thus, the connector requires only a small portion of the valuable surface area of the printed circuit board. Because the connector only uses a small portion of the surface area of the printed circuit board, the remaining portions of the printed circuit board can contain the desired circuitry and logic components to perform the desired functions of the communications card.

Further aspects, features and advantages of the present invention will become apparent from the detailed description of the preferred embodiments that follows.

Brief Description of the Drawings

The appended drawings contain figures of preferred embodiments of the card edge connector for a modular jack. The above-mentioned features of the card edge connector, as well as other features, will be described in connection with the preferred embodiments. However, the illustrated embodiments are only intended to illustrate the invention and not limit the invention. The drawings contain the following figures.

DETAILED DESCRIPTION OF PREFERRED EMBODIMENTS

The present invention involves a card edge connector for electrically connecting a modular jack to a communications card. The principles of the present invention, however, are not limited to card edge connectors for modular jacks. It will be understood that, in light of the present disclosure, the card edge connector disclosed herein can be successfully used in connection with other types of electrical equipment, devices and communications systems.

Additionally, to assist in the description of the card edge connector, words such as top, bottom, front, rear, right and left are used to describe the accompanying figures. It will be appreciated, however, that the present invention can be located in a variety of desired positions—including various angles, sideways and even upside down. A detailed description of the card edge connector for a modular jack now follows.

Figure 1:
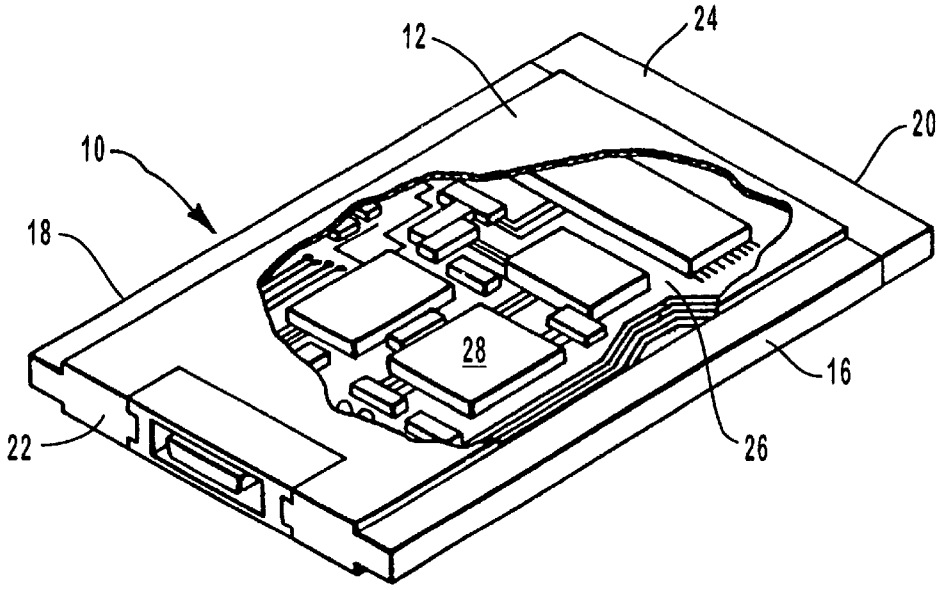
FIG. 1 (PRIOR ART)
FIG. 1 is a perspective view of a conventional communications card constructed in accordance with PCMCIA standards.
Figure 2:
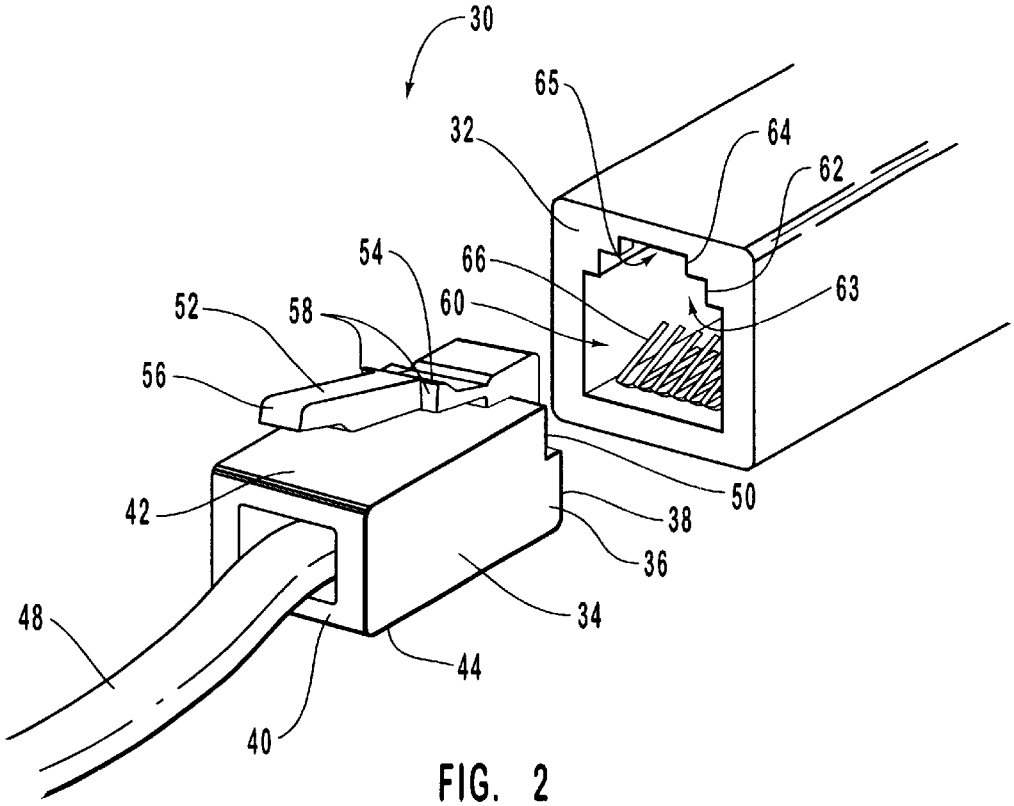
FIG. 2 (PRIOR ART)
FIG. 2 is a perspective view of a conventional RJ series connector, illustrating a plug and a corresponding receptacle.
Figure 3:
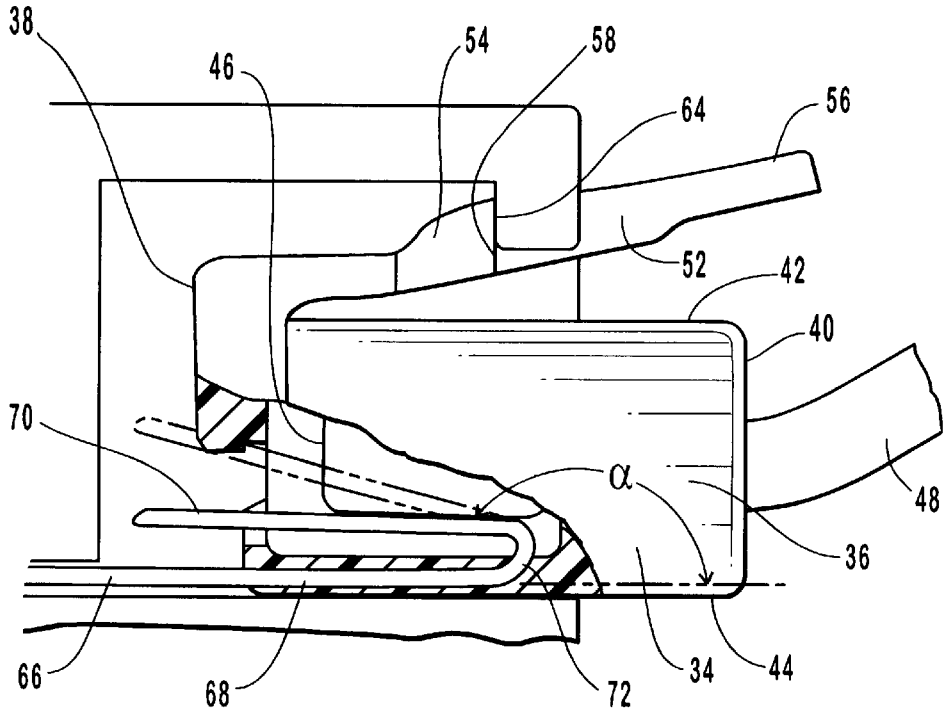
FIG. 3 (PRIOR ART)
FIG. 3 is a side view of the conventional RJ series connector shown in FIG. 2, with a portion of the plug and receptacle cut away, illustrating the plug inserted into the receptacle.
Figure 4:
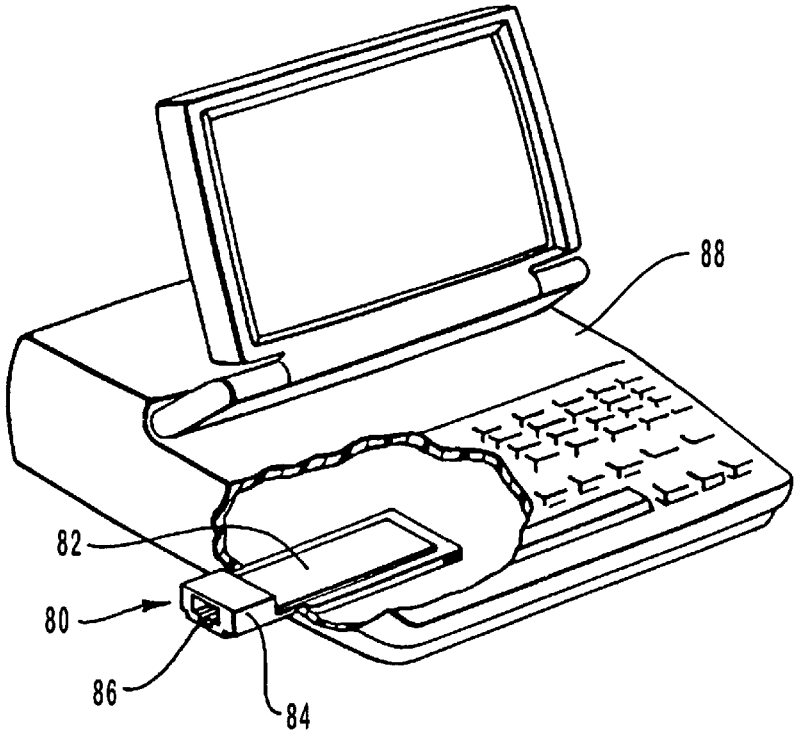
FIG. 4 (PRIOR ART)
FIG. 4 is a perspective view of a conventional communications card with an integrally attached RJ series receptacle, illustrating the communications card inserted into a computer, with a portion of the computer cut away.
Figure 5:
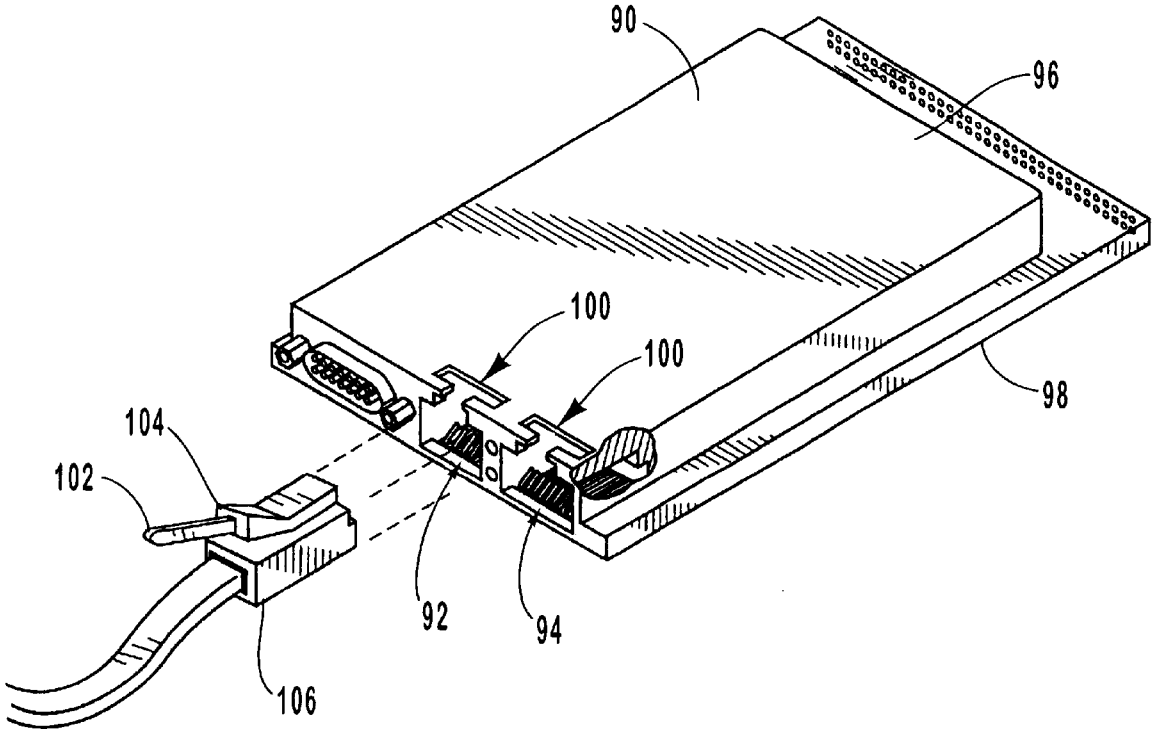
FIG. 5 (PRIOR ART)
FIG. 5 is a perspective view of a conventional connector for a communications card, illustrating a RJ series plug and cutouts along an upper surface of the communications
Figure 6:
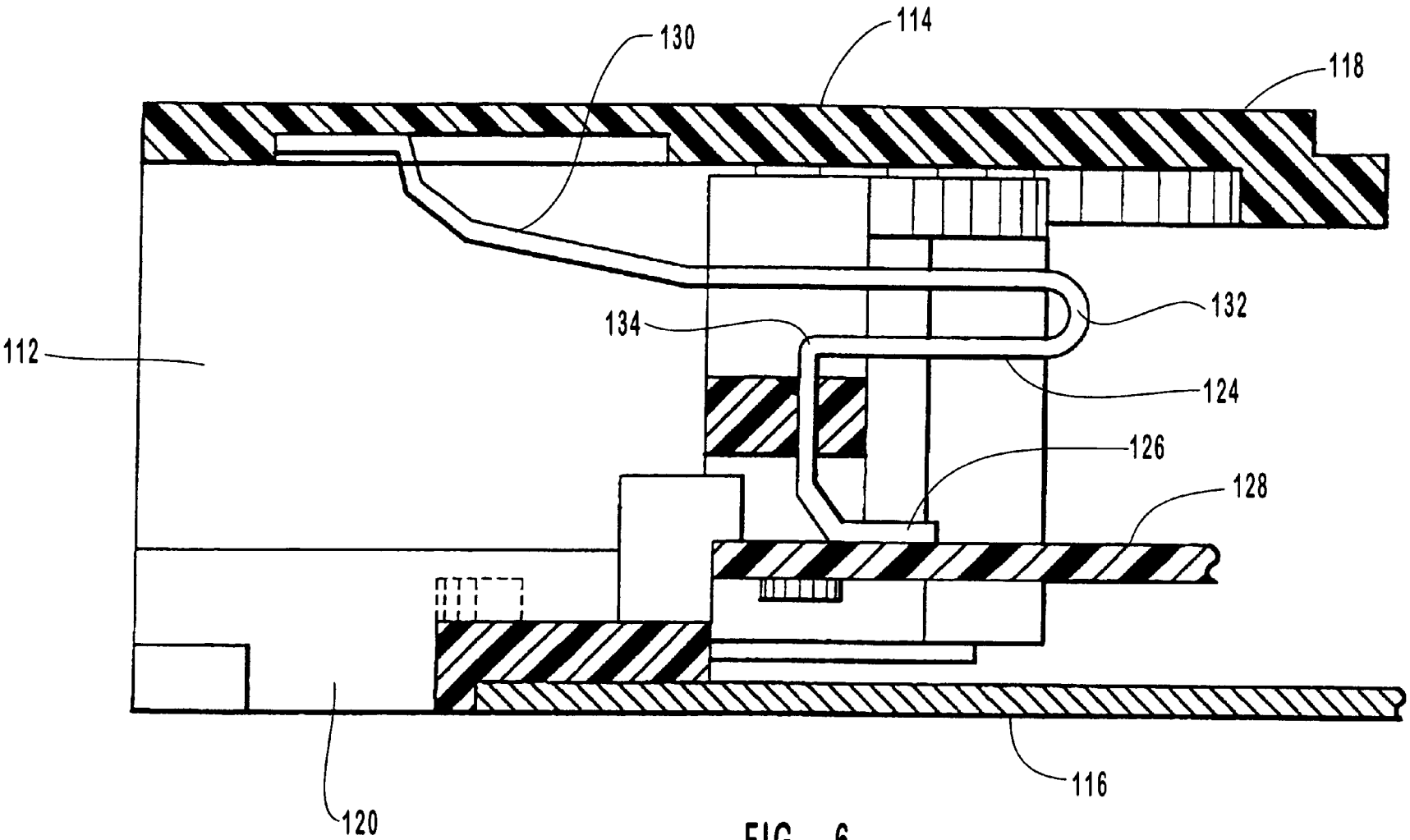
FIG. 6 (PRIOR ART)
FIG. 6 is a cross-sectional side view of a conventional connector for a communications card, with a portion of the communications card cut away, illustrating a receptacle portion located at the rear portion of the communications card.
Figure 7:
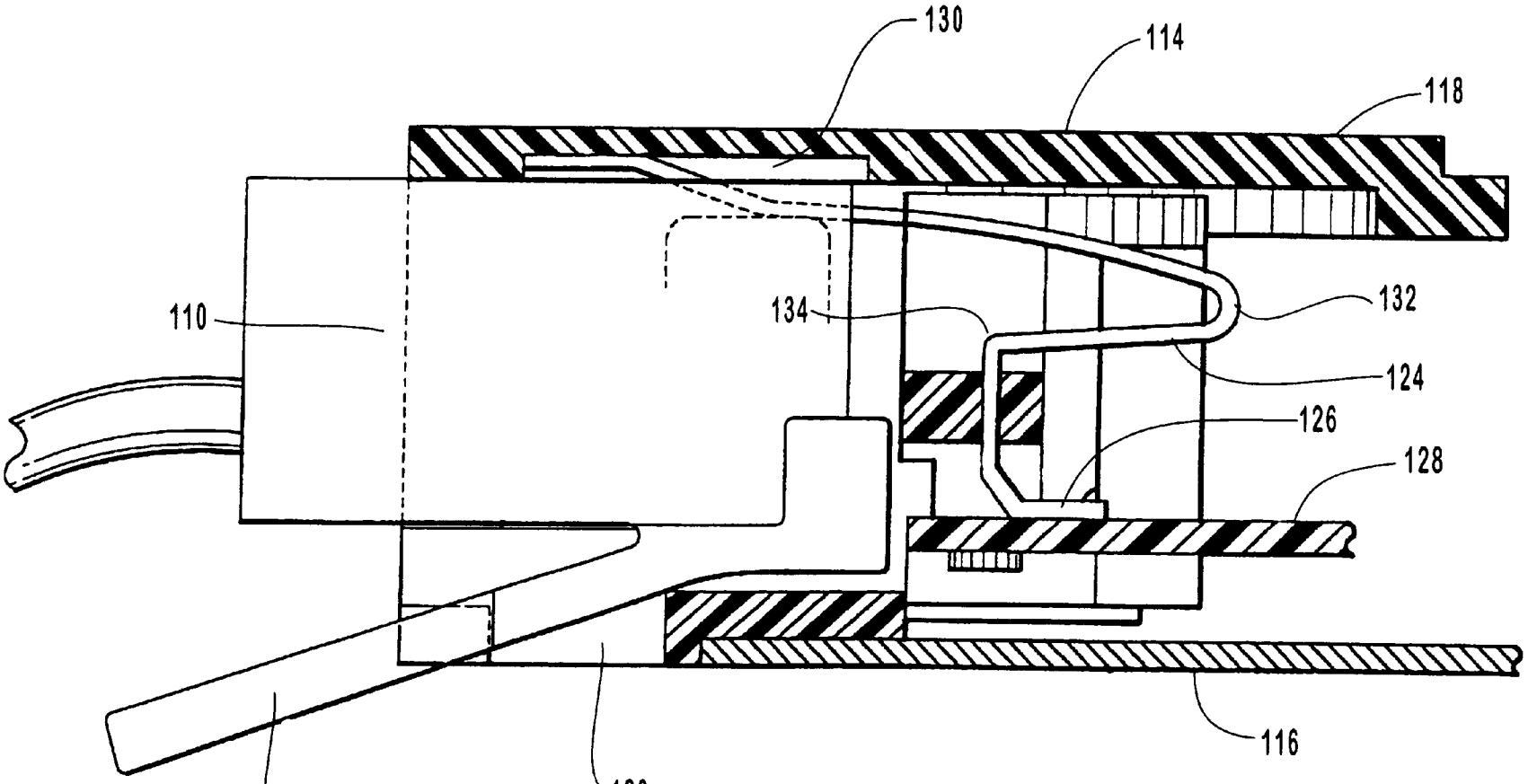
FIG. 7 (PRIOR ART)
FIG. 7 is the conventional connector shown in FIG. 6, illustrating a plug inserted into the receptacle.
Figure 8:
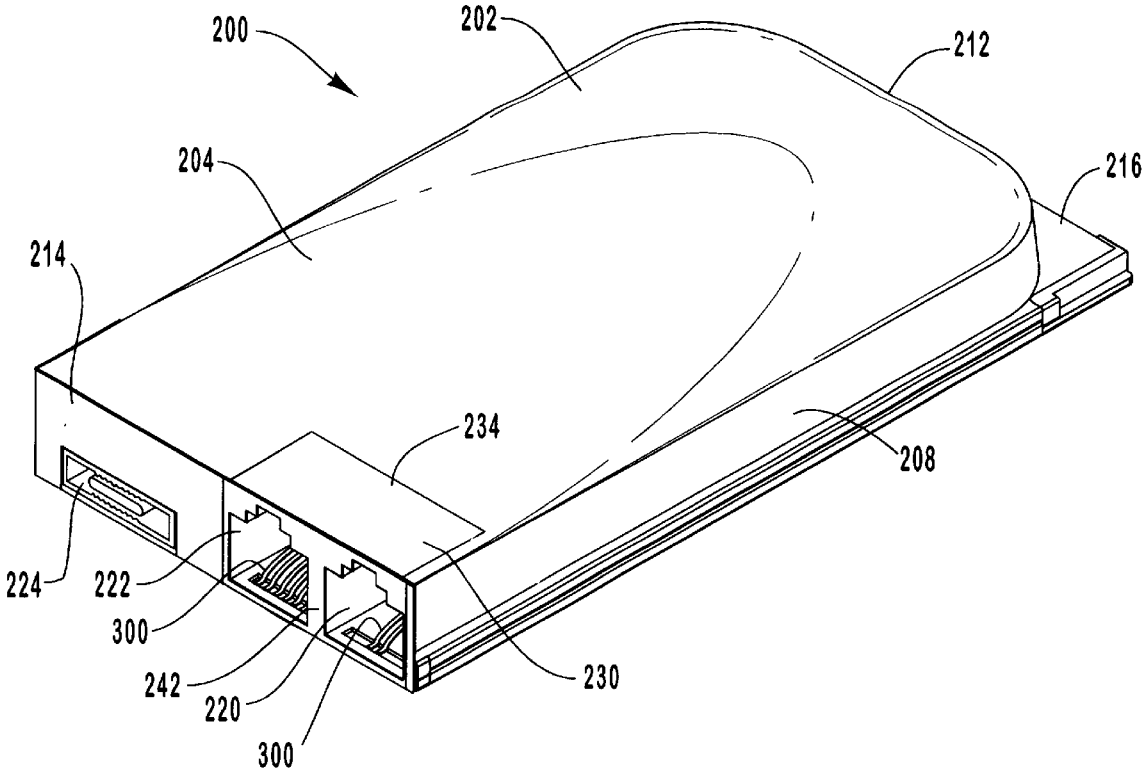
FIG. 8 is a perspective view of a communications card in accordance with a preferred embodiment of the present invention.
Figure 9:
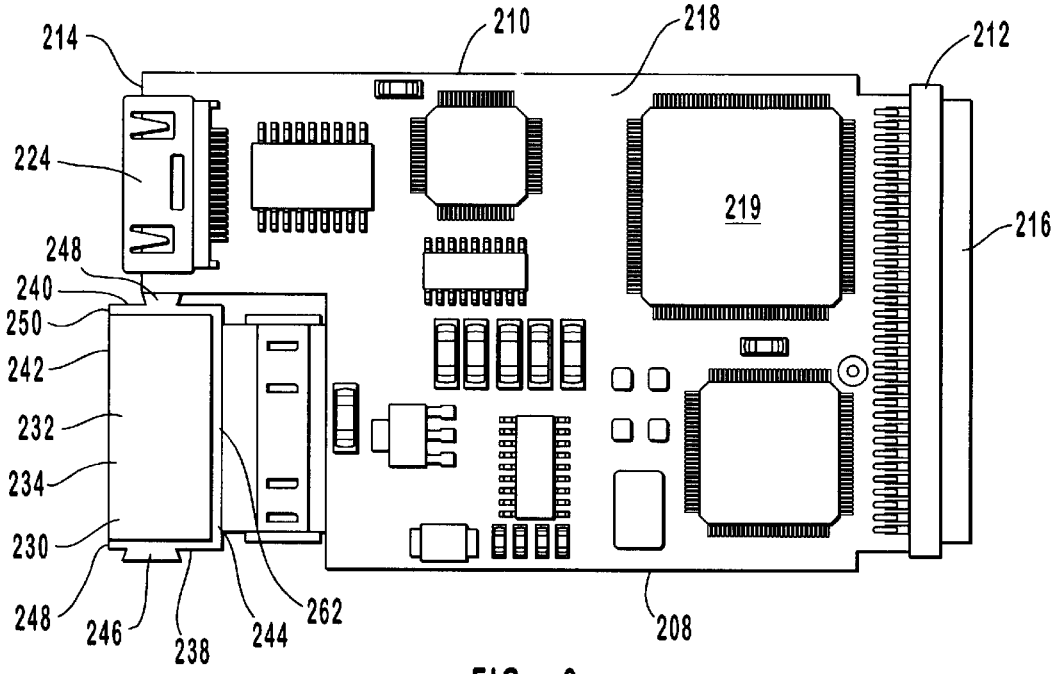
FIG. 9 is a top view of the communications card shown in FIG. 8, with the housing of the main body portion of the communications card removed.

As seen in FIGS. 8 and 9, a communications device in accordance with a preferred embodiment of the present invention includes a communications card 200 that is configured to be inserted into a corresponding socket of a host device such as a computer (not shown). The computer can be any type of a wide variety of computers including personal, portable, laptop, notebook, palm, personal data assistants (PDAs), etc. The communications card 200 includes a housing 202 with a generally rectangular shaped configuration having a top surface 204, bottom surface 206, right side 208, left side 210, front end 212 and rear end 214. The communications card 200 conforms to the Type III PCMCIA standards with a length of 85.6 mm (3.4 inches), a width of 54.0 mm (2.1 inches), and a height of 10.5 mm (0.4 inches), but it will be appreciated that the card may have other desired sizes and configurations that are suitable for its intended purpose, and the card does not have to conform to any specific standards or guidelines. A 68-pin connector 216 located at the front end 212 of the card 200 allows the card to communicate with the computer, but other suitable connectors such as serial, parallel, SCSI or other ports may also be used. A printed circuit board (PCB) or substrate 218 is located within the housing 202 and it includes logic circuitry and various components 219 necessary to perform the desired functions of the communications card 200.

Located at the rear end 214 of the card 200 are two receptacles 220 and 222 that are sized and configured to receive conventional RJ series plugs. Preferably, the receptacle 220 is sized and configured to receive a RJ-11 connector plug and the receptacle 222 is sized and configured to receive a RJ-45 connector plug, but it will be appreciated that the receptacles can be sized and configured to receive any desired RJ series plug or any other suitable type of plug. The rear end 214 of the card 200 preferably also includes a Sub-D connector 224 for connection to a cellular telephone or other suitable electronic equipment, but other types of connectors such as a pin, BNC or DIN connectors may also be connected to the communications card.

The receptacles 220 and 222 are located in a modular jack 230 that includes a main body portion 232 having a generally rectangular configuration with an upper surface 234, a lower surface 236, a right side 238, a left side 240, a front surface 242 and a rear surface 244. As shown in FIG. 8, the upper surface 234 of the modular jack 230 is generally aligned and planar with the top surface 204 of the housing 202 of the communications card 200. Additionally, the lower surface 236 of the modular jack 230 is generally aligned with the bottom surface 206 of the communications card 200. Thus, the height of the modular jack 230 is the generally equal to the height of the communications card 200. Additionally, as shown in the accompanying figures, the receptacles 220, 222 are located entirely in the front surface 242 of the modular jack 230, and the upper surface 234 of the modular jack 230 is a solid, planar surface that does not include any openings or cutouts.

The modular jack 230 is releasably attached to the housing 202 of the communications card 200 by a pair of guide rails 246, 248 that are located on the right and left sides 238, 240 of the jack, respectively. These guide rails 246, 248 have a dovetail shape and are received within corresponding slots (not shown) in the housing 202 of the communications card 200. The guide rails 246, 248 preferably have a friction or interference fit with the corresponding slots to securely attach the modular jack 230 to the housing 202 of the communications card 200. Because the modular jack 230 is securely attached to the housing 202 of the communications card 200, the forces associated with inserting and removing connector plugs from the receptacles are transmitted to the housing and not the printed circuit board 218.

Figure 11:
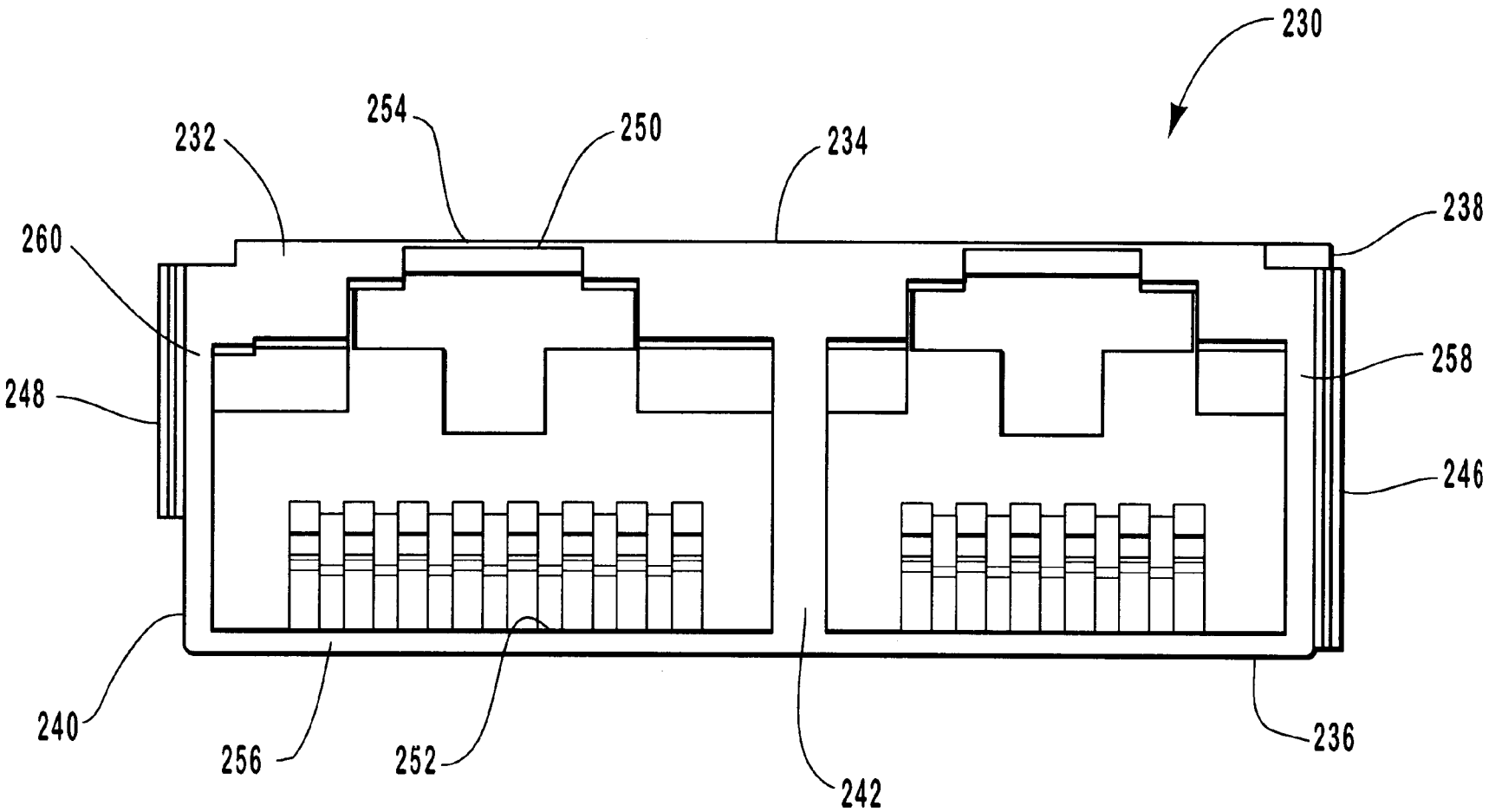
FIG. 11 is a front view of the modular jack shown in FIG. 10.

In a preferred embodiment, as best seen in FIG. 11, the main body portion 232 of the modular jack 230 has a height of about 10.5 mm measured from the upper surface 234 to the lower surface 236, and the receptacles 220, 222 have a height of about 10.1 mm measured from an uppermost surface 250 to the lower surface 252. The upper wall 254 of the receptacles 220, 222 has a thickness of about 0.2 mm and the lower wall 256 of the receptacles also has a thickness of about 0.2 mm. The main body portion 232 of the modular jack 230 has a depth of about 10.8 mm measured from the front surface 242 to the rear surface 244, and the receptacles 220, 222 have a depth of about 9.8 mm measured from the front surface to the inner surface of the rear wall 262 of the receptacle. The right and left sides walls 258, 260 of the modular jack 230 have a thickness of about 1.0 mm, and the rear wall 262 of the receptacles 220, 222 has a thickness of about 1.0 mm.

As seen in the accompanying figures, the modular jack 230 also includes a rearwardly extending connector 270 with a first end 272 attached to the modular jack 230 and an opposing second end 274. The rearwardly extending connector 270 has a length of about 8.7 mm and it is used to electrically connect the modular jack 230 to the printed circuit board 218. Those skilled in the art will readily appreciate, however, that the modular jack 230 can have a variety of different sizes and configurations depending, for example, upon the type of connectors, intended use of the communications card, size and shape of the communications card, and specific application of the communications card.

One or more contact pins are located within the receptacles 220, 222 of the modular jack 230. Typically, four or six contact pins are used in conjunction with an RJ-11 connector and eight contact pins are used in conjunction with an RJ-45 connector, but any suitable number of contact pins may be utilized. Advantageously, the contact pins shown in connection with these preferred embodiments can be used in conjunction with both RJ-11 and/or RJ-45 connectors. Thus, the same contact pin design may be used with one or more types of RJ connectors, but at the contact pins may be manufactured in any of a wide variety of designs and configurations in order to be used with specific applications or connectors. Thus, while the contact pins shown in the accompanying figures are representative of preferred embodiments, it will be appreciated that the contact pins may also have other suitable shapes and configurations.

As seen in FIGS. 12 to 15, exemplary contact pin 300 located in the receptacle 222 includes a plug engaging portion 302 and a connector portion 304. Briefly, the plug engaging portion 302 is flexible and elastically deforms or deflects as the plug 350 is inserted into the receptacle 222. The connector portion 304, on the other hand, is generally held in a generally fixed position and it is used to electrically connect the modular jack 230 to the printed circuit board 218 disposed within the housing 202 of the communications card 200. Additional details regarding preferred embodiments of the contact pin are provided in assignee's copending U.S. patent application Ser. No. 09/528,500, filed Mar. 20, 2000 entitled Contact Pin Design for a Modular Jack which is hereby incorporated by reference it its entirety.

The plug engaging portion 302 of the contact pin 300 extends generally along a longitudinal axis from the front surface 242 of the receptacle 222 to the rear end 274 of the rearwardly extending connector 270 of the modular jack 230. The plug engaging portion 302 of the contact wire 300 includes a first section 306 positioned within a groove or slot 308 located in the lower wall 256 of the receptacle 222. The groove 308 is located proximate the front surface 242 of the receptacle 222, where the plug 350 is initially inserted into the receptacle. The first section 306 has a generally planar configuration to help hold the plug engaging portion 302 of the contact pin 300 within the groove 308. The first section 306 also includes a generally planar or slightly upwardly extending end 307, but the end should not protrude above the upper surface of the groove 308 or into the receptacle 222. Because the first section 306 of plug engaging portion 302 is located below the lower surface 252 of the receptacle 222, the plug 350 will not catch on or contact the first section or the end 307 of the contact pin 300 when the plug is inserted into the receptacle. Additionally, the groove 308 prevents lateral or side-to-side movement of the contact pin 300, which helps prevent the pin from contacting other pins and it keeps the pins separated by the desired distance.

The first section 306 of the plug engaging portion 302 may be either movable or held in a fixed position within the groove 308 depending, for example, upon the desired use of the connector. If the first section 306 is desired to be movable within the groove 308, it should have sufficient size and length to allow movement within the groove but not be displaced from the groove. On the other hand, if the first section 306 is secured in a fixed position within the groove 308, it should have sufficient size and length to be securely held in place. In either configuration, the first section 306 should have sufficient surface area, material strength and stress dispersion capabilities to allow the contact pin 300 to deflect when the plug 350 is inserted, without the contact pin breaking or otherwise being damaged.

The contact pin 300 includes an upwardly angled section 310, which is the first portion of the contact pin to engage the plug 350 as it is inserted into the receptacle 222. The upwardly angled section 310 has a length of about 4 mm and it is connected to the first section 306 at an angle $\beta$ of between about 5° and about 60° . More preferably, the upwardly angled section 310 and the first section 306 are joined at an angle $\beta$ of about between about 30° and about 45° , or less, in order to minimize the stress on the contact pin 300 as it is inserted into the receptacle 222. One skilled in the art will appreciate that the angle and length of the upwardly angled section 310 may affect the deflection and stress on the contact pin 300, and that the upwardly angled section may have different lengths and angles depending upon the desired configuration of the pin.

The contact pin 300 also includes an elongated arm 312 connected to the upwardly angled section 310. A curved section 314 joins the upwardly angled section 310 and the elongated section 312 at an angle $\gamma$ between about 5° and 60° . More preferably, the curved section 314 joins the sections 310, 312 at about an angle $\gamma$ of about 30° to minimize the stress in the contact wire and to provide secure engagement of the contact wire 300 with corresponding contacts in the plug 350. The elongated arm 312 is preferably angled upwardly at an angle $\delta$ between about 5° and 15° , but the angle could be greater or smaller. It will be appreciated that the plug engaging portion 302 of the contact wire 300 may also be generally straight and not include the curved section 314, or the contact wire may include one or more curved sections. The plug engaging portion 302, however, does not include any portions that are angled at more than 90° in order to minimize stress and increase durability of the pin. More preferably, the plug engaging portion 302 does not include any portions that are angled more than 60° to further increase reliability and decrease stress.

The elongated arm 312 preferably has a length of about 10.0 mm, which is generally equal to or greater in length than the depth of the receptacle 222. Because the arm 312 has an elongated length, it permits a relatively large deflection of the pin 300 as the plug 350 is inserted into the receptacle 222. The distal end 316 of the elongated arm is disposed within a slot 318 located in the rearwardly extending connector 270. The slot 318 allows the elongated arm 312 to move vertically while preventing lateral or side-to-side movement of the contact pin 300. The slot 318 is aligned with the groove 308 located proximate the front surface 242 of the receptacle to position the contact pin 300 in the desired location.

The elongated arm 312 is attached to the connector portion 304 and the connector portion is used to electrically connect the contact pin 300 to the printed circuit board 218. As discussed in greater detail below, the connector portion 304 includes a flat first section 320, a curved section 322 and an engaging portion 324 that is sized and configured to electrically engage corresponding contacts 326 on the printed circuit board 218.

Figure 10:
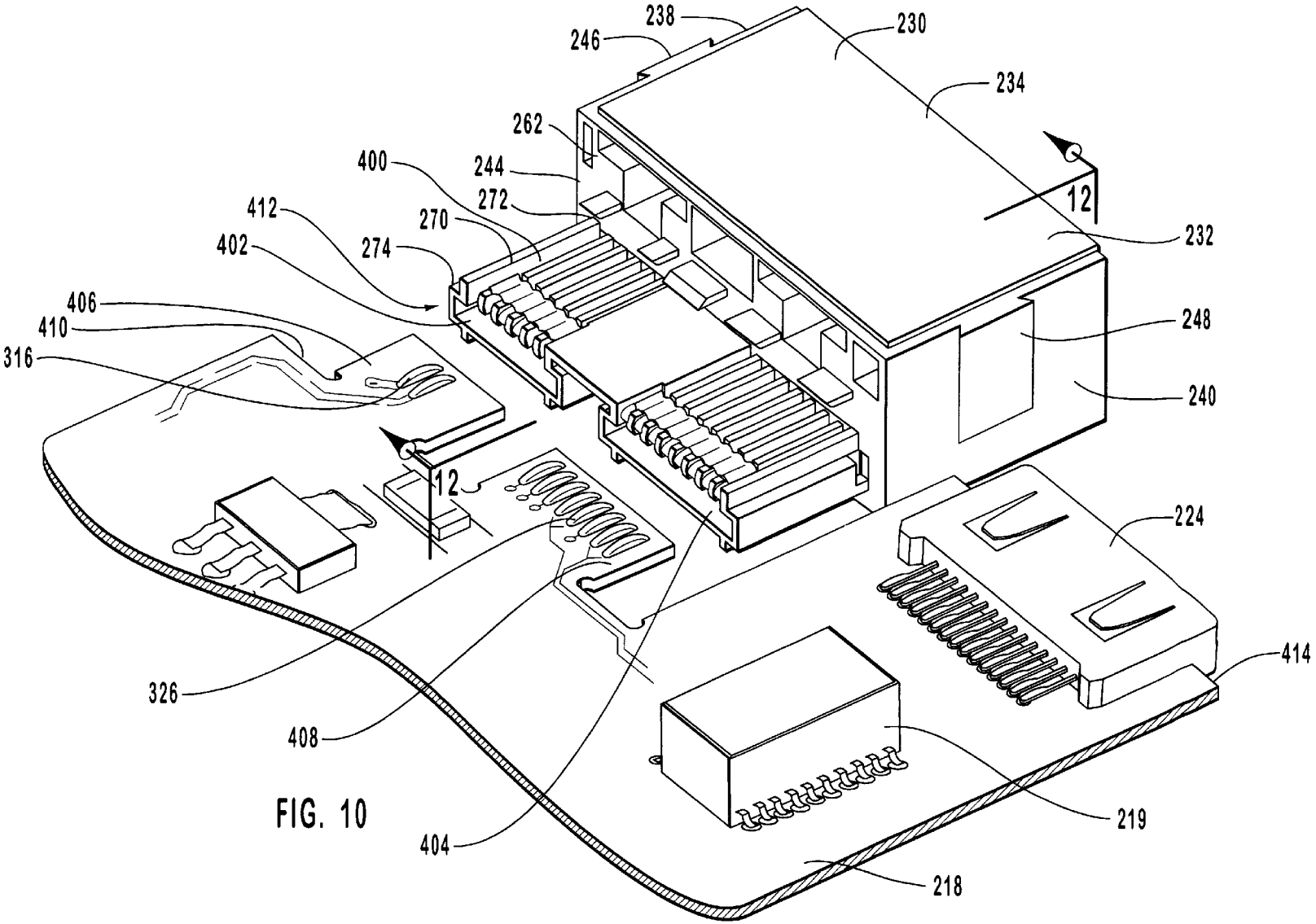
FIG. 10 is an exploded, perspective view of a portion of the communications card shown in FIG. 9, illustrating the modular jack detached from the printed circuit board, with a portion of the printed circuit board cut away.

As best seen in FIG. 10, the modular jack 230 includes the rearwardly extending connector 270 that is integrally attached to the rear wall 262 of the main body portion 232 of the modular jack. The rearwardly extending connector 270 includes a body 400 with a first socket 402 and a second socket 404 that are sized and configured to receive corresponding portions 406, 408 of the printed circuit board 218. The portions 406, 408 are located proximate an inner edge 410 of the printed circuit board 218 and preferably project outwardly from the inner edge of the printed circuit board. Desirably, the inner edge 410 forms part of a relief or cutout 412 of the printed circuit board 218 that is sized and configured to receive the modular jack 230. More desirably, the relief 412 is sized and configured such that when the modular jack 230 is electrically connected to the printed circuit board 218, the front surface 242 of the modular jack is generally aligned with the front surface of the connector 224 or a front edge 414 of the printed circuit board. It will be understood that the portions 406, 408 of the printed circuit board 218 may also be aligned with the inner edge 410 of the printed circuit board 218 or be recessed into the printed circuit board.

Disposed on the upper surface of the printed circuit board 218 are contacts 326 that are electrically connected to desired circuitry or components 219 on the printed circuit board. These contacts 326 may comprise a portion of an electrical lead or trace, and the contacts preferably have a length less than the length of the portions 406, 408 of the printed circuit board 218. The number of contacts 326 on the printed circuit board 218 desirably corresponds to the number of contact pins 300 in the modular jack 230, but it is contemplated that the number of contacts may not correspond to the number of contact pins. Additionally, although not shown in the accompanying figures, one skilled in the art will recognize that the lower surface of the printed circuit board 218 may also include electrical contacts that are electrically connected to the modular jack 230.

Figure 12:
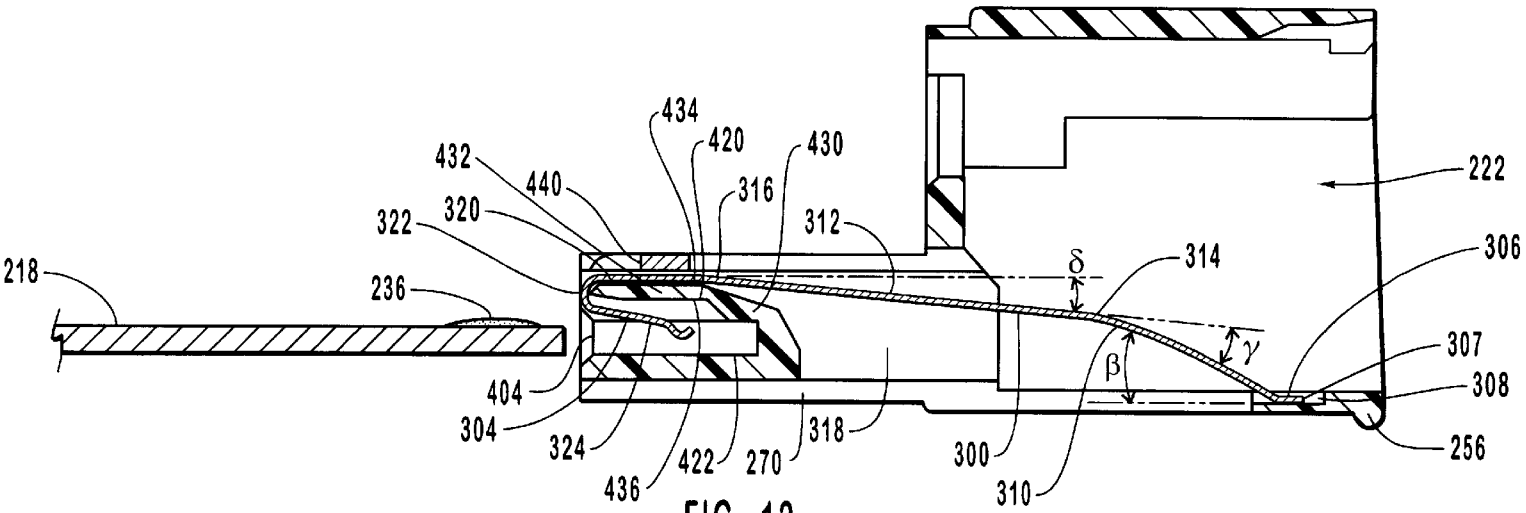
FIG. 12 is a cross-sectional side view of the modular jack shown in FIG. 11, illustrating a printed circuit board proximate the opening to a socket in the modular jack.
Figure 13:
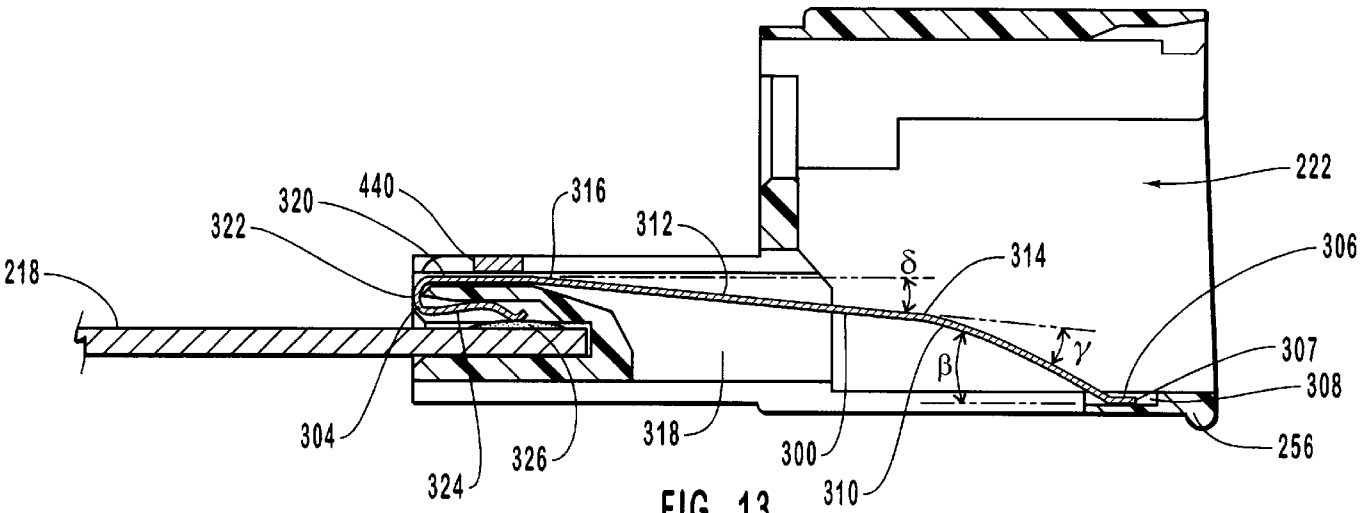
FIG. 13 is a cross-sectional side view of the modular jack shown in FIG. 12, illustrating the printed circuit board inserted into the socket of the modular jack.

The sockets 402, 404 in the body 400 of the rearwardly extending connector 270 include a top wall 420, a bottom wall 422, a right sidewall 424, a left sidewall 426 and a rear wall 428. As best seen in FIGS. 12 and 13, the top wall 420 and the bottom wall 422 are separated by two different heights such that the rear end 430 of the sockets 402, 404 have a height that is slightly greater than the thickness of the printed circuit board 218. The forward end 432 of the sockets 402, 404, however, have a larger height such that the printed circuit board 218 and the engaging portion 324 of the contact pin 300 can be disposed between the top wall 420 and the bottom wall 422 of the receptacle.

The upper surface 434 and lower surface 436 of the top wall 420 of the sockets 402, 404 preferably include grooves that are sized and configured to receive the connector portion 304 of the contact pins 300. In greater detail, the upper surface 434 of the top wall 420 includes grooves 438 that contain the first flat sections 320 of the contact pin 300 and these grooves are aligned with the slots 318 that extend towards the rear wall 262 of the modular plug 230. A cross member 440 holds the first flat sections 320 of the contact pins 300 in a fixed position relative to the rearwardly extending connector 270. Thus, the connector portion 304 of the contact pins 300 generally does not bend or deflect as the plug 350 is inserted or removed from the receptacle 222. Instead, the plug engaging portion 302 primarily bends or deflects as the plug 350 is inserted or removed from the receptacle 222.

The lower surface 436 of the top wall 420 may also include grooves 442 that are generally aligned with the grooves 438 in the upper surface 434 of the top wall 420. These grooves 442 in the lower surface 436 receive the engaging portions 324 of the contact pins 300 when the rearwardly extending connector 270 is attached to the printed circuit board 218. One skilled in the art will appreciate that the grooves 438, 442 in the upper and lower surfaces 424, 426 of the top wall 420 are not required and that other suitable types of alignment devices, such as walls or partitions, may also be used to position the contact pins 300 in the desired locations.

As shown in FIGS. 12 to 15, the first flat section 320 of the connector portion 304 is located generally parallel to the lower surface 252 of the receptacle 222 and the curved section 322 is curved about the rear end 274 of the rearwardly extending connector 270. The engaging portion 324 of the contact pin 300 extends into the socket 404 and it resiliently engages the contact 326 on the upper surface of the printed circuit board 218. This allows electrical communication between the printed circuit board 218 and the contact pin 300 to be established. Advantageously, because the engaging portion 324 of the contact pin 300 is biased to engage the contact 326, this results in positive electrical contact between the contact and the contact pins. If the modular jack 230 is disconnected from the printed circuit board 300, the portions 406, 408 of the printed circuit board 218 are removed from the sockets 402, 404 and the engaging portion 324 of the contact pin 300 resiliently springs back to its original position. Thus, the modular jack 230 and the printed circuit board 218 can be repeatedly attached and disconnected as desired.

Figure 16:
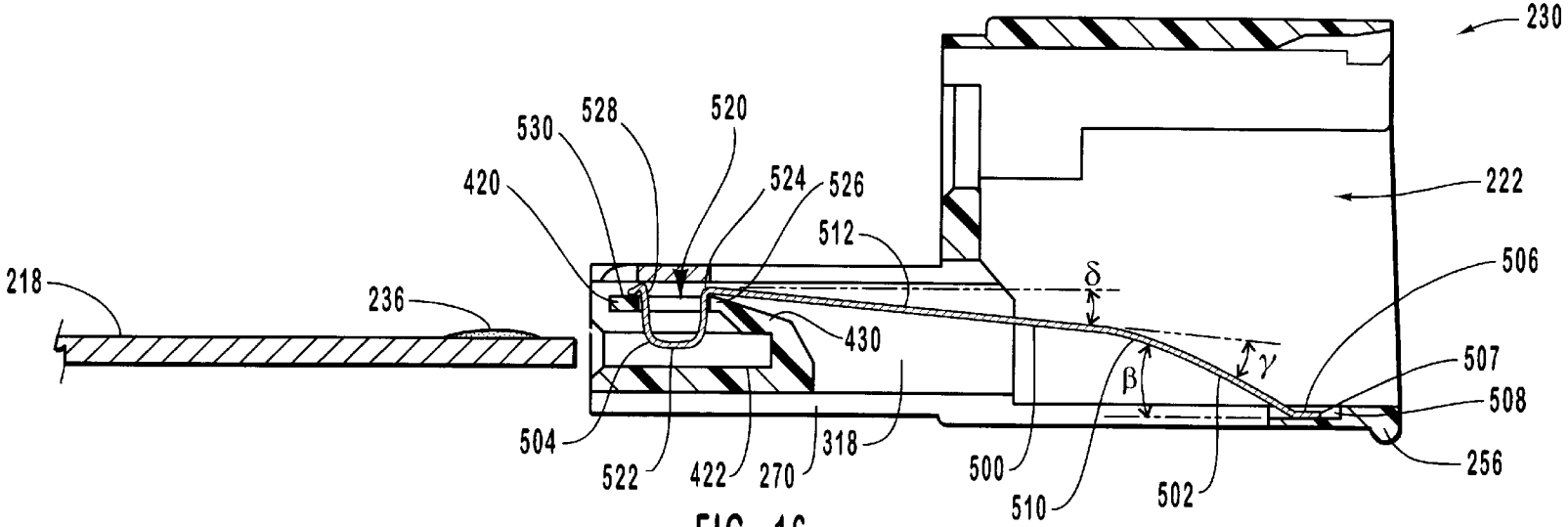
FIG. 16 is a cross-sectional side view of a modular jack in accordance with another preferred embodiment of the present invention, illustrating a printed circuit board proximate the opening to a socket of the modular jack.
Figure 17:
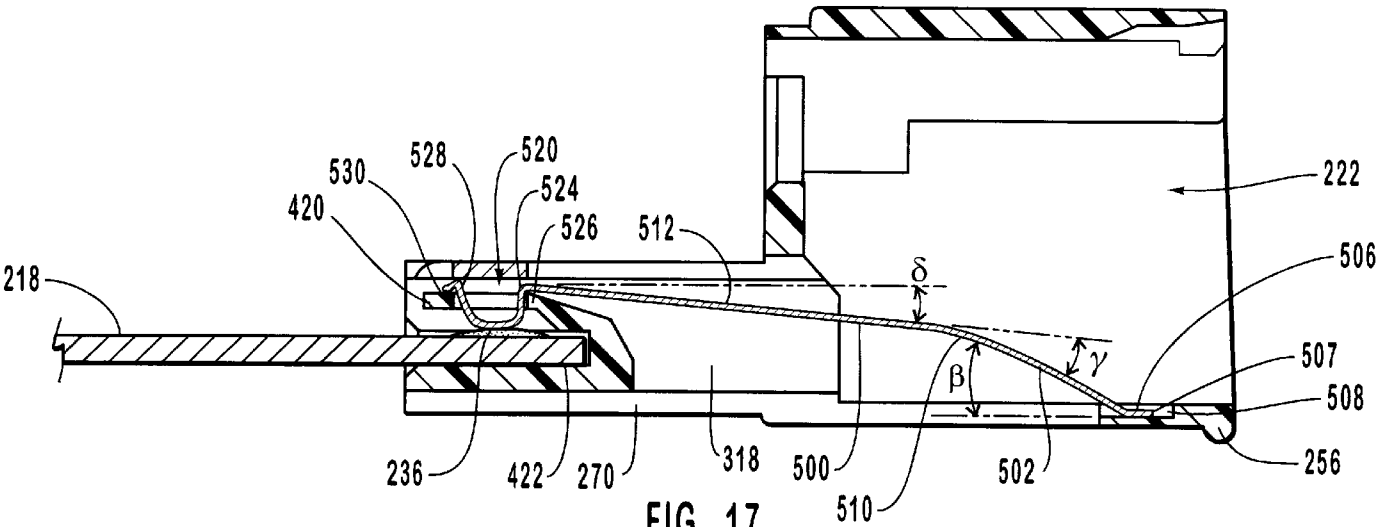
FIG. 17 is a cross-sectional side view of the modular jack shown in FIG. 16, illustrating the printed circuit board inserted into the socket of the modular jack.

Another preferred embodiment of the modular jack 230 is shown in FIGS. 16 and 17. The exemplary contact pin 500 includes a plug engaging portion 502 and a connector portion 504. The plug engaging portion 502 includes a first section 506 positioned within a groove or slot 508 located in the lower wall 256 of the receptacle 222. The groove 508 is located proximate the front surface of the receptacle 222, where the plug 350 is initially inserted into the receptacle. The first section 506 may also include a generally planar or slightly upwardly extending end 507, but the end should not protrude above the upper surface of the groove or into the receptacle 222. As discussed above, the first section 506 of the plug engaging portion may be either movable or held in a fixed position with the groove 508. The contact pin 500 also includes an upwardly angled section 510 and an elongated arm 512, which are preferably similar to that discussed in connection with the contact pin 300.

The connector portion 504 of the contact pin 500 is inserted through an opening or aperture 520 located in the top wall 420 of the socket 402. The connector portion 504 includes a curved section 522 that is configured to electrically communicate with a contact 236 disposed on the upper surface of the printed circuit board 218. The curved section 522 includes a first section 524 positioned proximate the first end 526 of the opening 520 and a second section 528 positioned proximate the second end 530 of the opening. The first section 524 of the connector portion 504 is preferably held in a generally fixed position relative to the first end 526 of the opening 520 and the second end 528 is also preferably held in a generally fixed position relative to the second end 530 of the opening. Alternatively, the first or second ends 524, 528 of the contact pin 500 may be movable relative to the opening 520 to allow the connector portion 504 of the contact pin 500 to move when it engages the printed circuit board 218. The connector portion 504 of the contact pin 500, however, is held in a generally stationary position as the plug 350 is inserted or removed from the receptacle 222.

Figure 18:
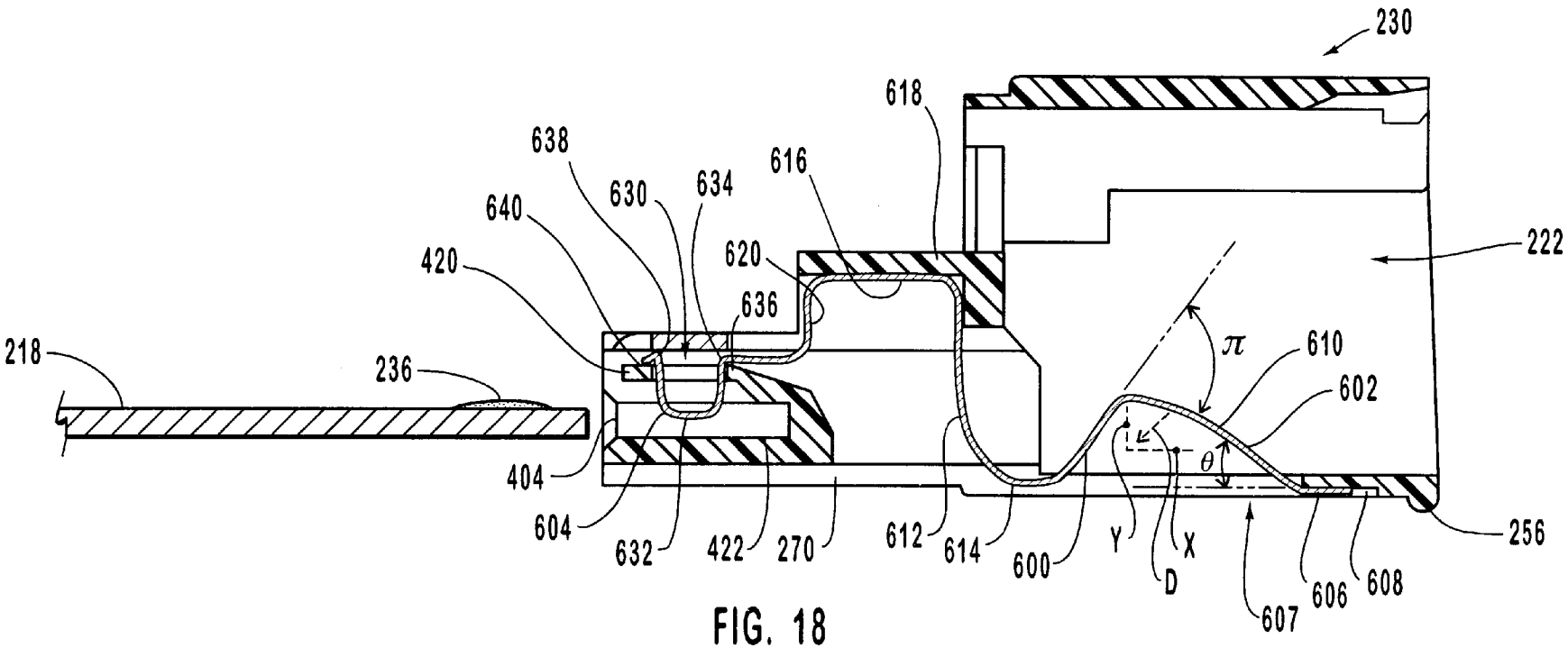
FIG. 18 is a cross-sectional side view of a modular jack in accordance with still another preferred embodiment of the present invention, illustrating another preferred embodiment of the contact pin and a printed circuit board proximate the opening to a socket of the modular jack.

Another preferred embodiment of the modular jack 230 is shown in FIG. 18. In this embodiment, the modular jack 230 includes a contact pin 600 with a plug engaging portion 602 and a connector portion 604. The plug engaging portion 602 includes a first section 606 that is inserted through an opening 607 in the lower wall 256 of the receptacle 222 and it is positioned within a groove or slot 608 located in the lower surface of the lower wall. The first section 606 of the plug engaging portion 602 may be either movable or held in a fixed position within the groove 608. The contact pin 600 also includes an upwardly angled section 610 that is sized and configured to engage the corresponding contacts 352 on the plug 350 as the plug is inserted into the receptacle 222. The upwardly angled section 610 is connected to the first section 306 at an angle θ of between about 30° and about 60° . More preferably, the upwardly angled section 610 and the first section 606 are joined at an angle θ of about 45° in order to minimize the stress on the contact pin 600 as the plug 350 is inserted into the receptacle 222. One skilled in the art will appreciate that the angle and length of the upwardly angled section 610 may impact the deflection and stress on the contact pin 600, and that the upwardly angled section may have different lengths and angles depending upon the desired configuration of the pin.

A second section 612 is attached to the upwardly angled section 610 at an angle π of about 80° and the second section includes a curved section 614 that is attached to a generally straight third section 616. The relatively large curved section 614 helps minimize the stresses in the contact pin 600 as the plug 350 is inserted into the receptacle 222. The generally straight third section 616 is located in an enlarged portion 618 of the rearwardly extending connector 270 and it is connected by a fourth section 620 to the connector portion 604. The connector portion 604 is inserted through an opening or aperture 630 located in the top wall 420 of the socket 402. The connector portion 604 includes a curved section 632 that is configured to electrically communicate with the contact 236 disposed on the upper surface of the printed circuit board 218. The curved section 632 includes a first section 634 positioned proximate the first end 636 of the opening 630 and a second section 638 positioned proximate the second end 640 of the opening. The first section 634 of the connector portion 604 is preferably held in a generally fixed position relative to the first end 636 of the opening 630 and the second end 638 is also preferably held in a generally fixed position relative to the second end 640 of the opening. Alternatively, the first or second ends 634, 638 of the contact pin 600 may be movable relative to the opening 630 to allow the connector portion 604 of the contact pin to move when it engages the printed circuit board 218. The connector portion 604 of the contact pin 600, however, is held in a generally stationary position as the plug 350 is inserted or removed from the receptacle 222.

Numerous specific dimensions and configurations are provided in connection with preferred embodiments of the communications card, contact pins and modular jacks. It will be understood, however, that these and other dimensions and configurations may be changed or modified for specific applications and designs. Thus, for example, the sockets 402, 404 may have different sizes and configurations such as square, circular, rounded, and the like.

The modular jack 230 and rearwardly extending connector 270 are desirably integrally molded, for example, by injection molding, thermal forming, vacuum forming of a preformed sheet of plastic, and the like. Alternatively, these components can be stamped, molded, machined, etc., and then bonded together to form the desired configuration. The bonding process can involve thermal bonding, solvent bonding, ultrasonic welding or other techniques known in the art. These components are desirably constructed from plastics such nylon, but other suitable plastic, synthetic and other metallic or nonmetallic materials may also be used.

In operation, as shown in FIGS. 12 and 13, the printed circuit board 218 is inserted into the socket 404 in the body 400 of the rearwardly extending connector 270. As the circuit board 218 is inserted into the socket 404, the circuit board engaging portion 324 first touches the edge of the circuit board and this causes the connector portion 304 of the contact pin 300 to deflect upwardly. The engaging portion 324 then engages the electrical contact 236 on the upper surface of the circuit board, and that allows electrical communication between the circuit board 218 and the contact pin 300 to be established. Desirably, the engaging portion 324 is biased against the electrical contact 236 to create positive electrical engagement of the electrical contact and the contact pin.

The modular jack 230 is preferably releasably attached to the printed circuit board 218 to allow the modular jack to be quickly and easily disconnected from the circuit board. In particular, the circuit board 218 can be simply removed from the socket 404 and that disconnects the engaging portion 324 from the electrical contact 236 on the upper surface of the circuit board. Advantageously, because the engaging portion 324 is flexible, it resiliently returns to its original position as shown in FIG. 12. Thus, the modular jack 230 can be repeatedly attached and removed from the circuit board 218. This allows the modular jack 230 to be quickly and easily replaced or repaired, and it allows modular jacks with different configurations and/or types of receptacles to be attached to the circuit board 218.

Figure 14:
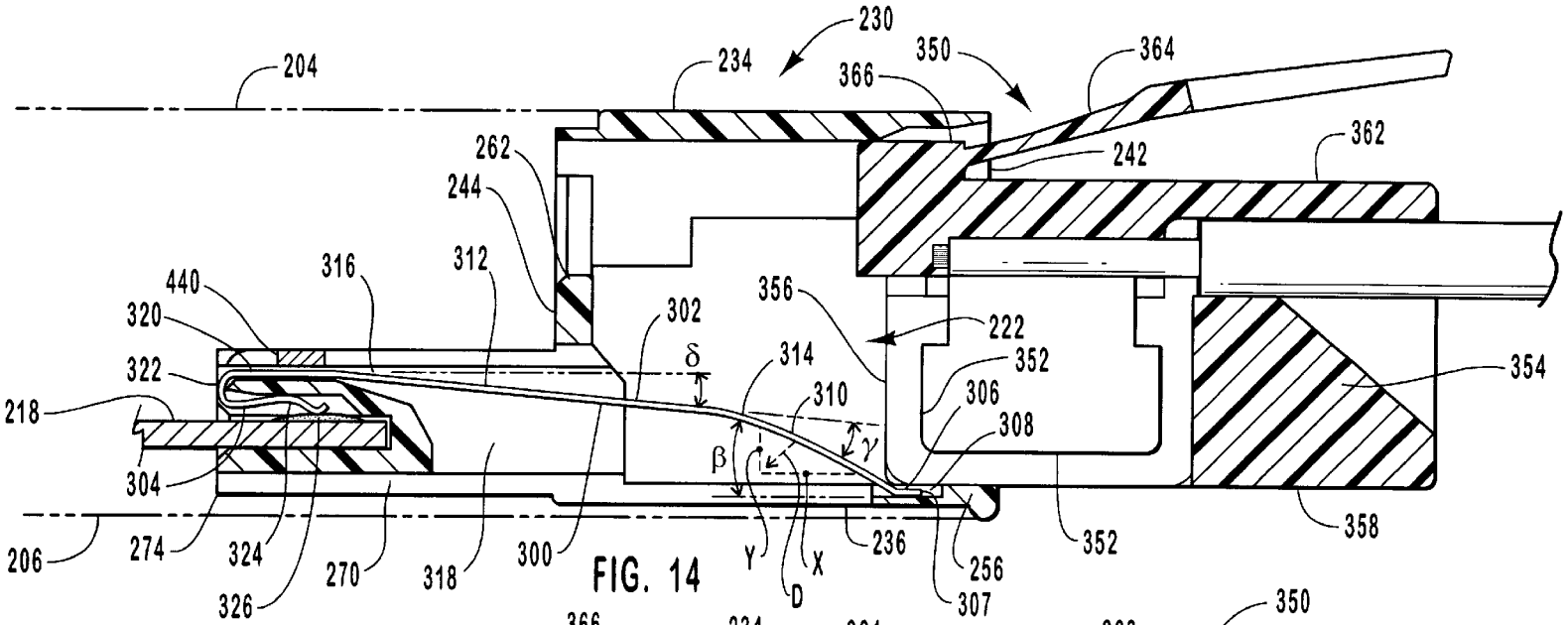
FIG. 14 is a cross-sectional side view of the modular jack shown in FIG. 12, illustrating the printed circuit board inserted into the socket of the modular jack and a plug being initially inserted into the opening to the receptacle of the modular jack.
Figure 15:
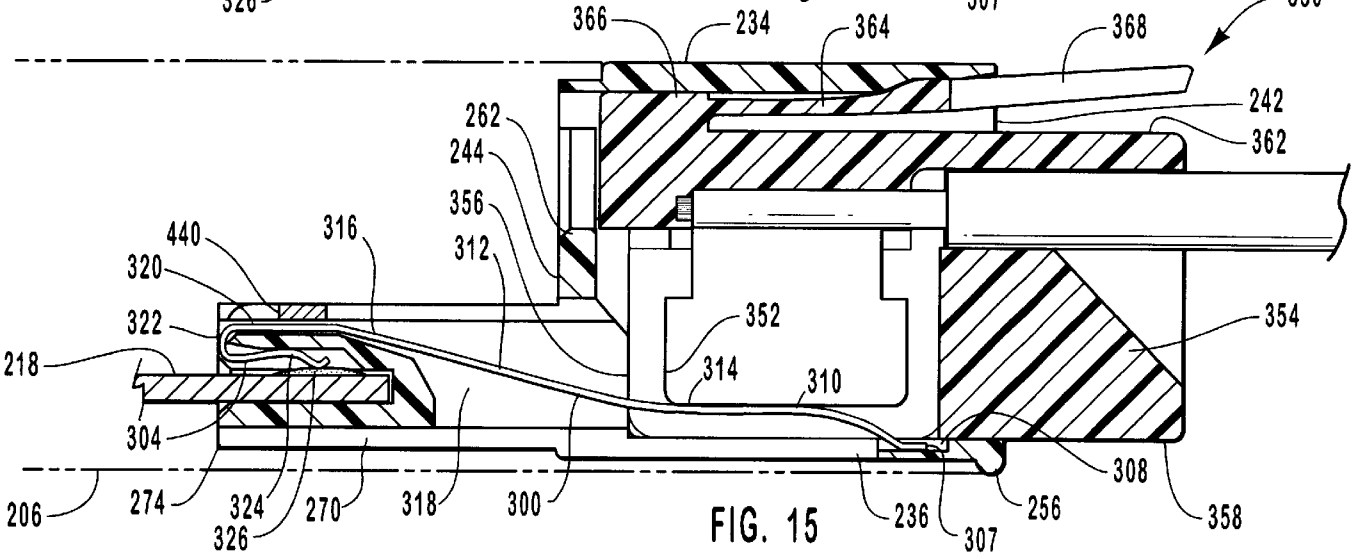
FIG. 15 is a cross-sectional side view of the modular jack shown in FIG. 12, illustrating the printed circuit board inserted into the socket of the modular jack and the plug inserted into the receptacle of the modular jack.

As best seen in FIGS. 14 and 15, the plug 350 is inserted into the receptacle 222 located in the front surface 242 of the modular jack 230. As the plug 350 is inserted into the receptacle, the upwardly angled section 310 of the contact pin 300 engages corresponding contacts 352 on the plug and this causes the plug engaging portion 302 to deform or deflect. Thus, as the plug 350 pushes against the upwardly angled section 310, the plug engaging portion 302 of the contact pin 300 is deflected both horizontally and vertically. Advantageously, because this plug engaging portion 302 of the contact pin 300 does not include any portions that are joined at an angle of more than 90°, more preferably more than 60°, the pin does not include any significant stress points or stress concentrations that typically lead to failure in conventional contact pins. Further details regarding preferred embodiments of connecting the plug to the receptacle are provided in assignee's copending U.S. patent application Ser. No. 09/528,331, entitled Modular Jack for PCMCIA Type III cards, which is hereby incorporated by reference it its entirety.

In another preferred embodiment, as shown in FIGS. 16 and 17, when the printed circuit board 218 is inserted into the socket 404, the downwardly curved portion 522 of the circuit board engaging portion 504 contacts the electrical contact 326 on the upper surface of the printed circuit board 218. This contact allows electrical communication between the circuit board 218 and the contact pin 500 to be established. Desirably, the curved portion 522 is biased against the electrical contact 236 to create positive electrical engagement of the electrical contact and the contact pin. Additionally, the circuit board 218 can be simply removed from the socket 404 and that disconnects the curved portion 522 from the electrical contact 236 on the upper surface of the circuit board. Advantageously, because the curved portion 522 is flexible, it resiliently returns to its original position as shown in FIG. 16. Thus, the modular jack 230 can be repeatedly attached and removed from the circuit board 218, and this allows the modular jack to be quickly repaired or replaced.

As seen in FIG. 18, when the printed circuit board 218 is inserted into the socket 404, the curved portion 632 contacts the electrical contact 326 on the upper surface of the printed circuit board 218 and this allows electrical communication between the circuit board and the contact pin to be established. Because the curved portion 632 is biased against the electrical contact 236, positive electrical engagement of the electrical contact and the contact pin 600 is created. Further, the circuit board 218 can be repeatedly inserted and removed from the socket 404 because the curved portion 632 is flexible and it resiliently returns to its original position.

Although this invention has been described in terms of a certain preferred embodiments, other embodiments apparent to those of ordinary skill in the art are also within the scope of this invention. Accordingly, the scope of the invention is intended to be defined only by the claims that follow.

What is claimed is:

1. A card edge connector for a communications card that conforms to the PCMCIA requirements for a Type III PC card, the card edge connector comprising:

a modular jack including a main body portion with a top surface, a bottom surface, a front surface and a rear surface, the top surface and the bottom surface being separated by a distance of 10.5 mm or less;

a receptacle disposed in the front surface of the modular jack that is sized and configured to receive a RJ series connector plug along a generally longitudinal axis such that no portion of the plug extends through either the top surface or the bottom surface of the modular jack when the plug is inserted into the receptacle; and a connector attached to the rear surface of the modular jack, the connector including a socket sized and configured to receive a portion of a printed circuit board disposed within the communications card, the connector being adapted to allow electrical communication to be established between the printed circuit board and the modular jack;

wherein there is no cutout that is configured to allow a biased clip of the RJ series connector plug to protrude through either the top surface or the bottom surface of the modular jack when the plug is inserted into the receptacle.

2. The card edge connector as in claim 1, wherein the modular jack is detachably connected to the printed circuit board.

3. The card edge connector as in claim 1, further comprising at least one contact pin including a plug engaging portion and a printed circuit board engaging portion, the plug engaging portion extending into the receptacle and the printed circuit board engaging portion extending into the socket.

4. The card edge connector as in claim 3, wherein the printed circuit board engaging portion is sized and configured to be electrically connected to a contact on the upper surface of the printed circuit board to allow the electrical communication between the printed circuit board and the modular jack to be established.

5. The card edge connector as in claim 3, further comprising a groove in an upper surface of a top wall of the socket, wherein a portion of the contact pin is disposed within the groove.

6. The card edge connector as in claim 3, further comprising at least one slot in the connector, at least a portion of the slot positioned between the rear wall of the modular jack and a distal end of the connector, wherein a portion of the contact pin is disposed within the slot.

7. The card edge connector as in claim 1, wherein the socket in the connector has a generally rectangular configuration that is defined by a top wall, a bottom wall, and two sidewalls.

8. The card edge connector as in claim 7, further comprising one or more grooves in an upper surface of the top wall of the socket, the one or more grooves being sized and configured to receive one or more contact pins.

9. The card edge connector as in claim 8, further comprising one or more slots in the connector, the one or more slots being generally aligned with the one or more grooves in the top wall of the socket.

10. The card edge connector as in claim 7, further comprising a cross member disposed across the top wall of the socket, the cross member being sized and configured to hold one or more contact pins in a fixed position.

11. The card edge connector as in claim 8, wherein the contact pins are held in a substantially fixed position within the grooves.

12. A card edge connector for connecting an electronic device or communication system to a communications card conforming to Type III PCMCIA standards, the card edge connector comprising:

a modular jack including a main body portion with a top surface, a bottom surface, a front surface and a rear surface, the top surface being separated from the bottom surface by a distance of 10.5 mm or less;

a receptacle located in the front surface of the modular jack that is sized and configured to receive a RJ series connector plug along a generally longitudinal axis such that no portion of the plug extends through either the top surface or the bottom surface of the modular jack when the plug is inserted into the receptacle;

a rearwardly extending connector attached to the rear surface of the modular jack, the connector including a socket sized and configured to removably receive an edge of a printed circuit board including one or more electrical contacts; and a plurality of contact pins, each of the plurality of contact pins including a plug engaging portion that is at least partially disposed within the receptacle and a printed circuit board engaging portion that is at least partially disposed within the socket, the plurality of contact pins allowing electrical communication to be established between the receptacle and the printed circuit board;

wherein there is no cutout that is configured to allow a biased clip of the RJ series connector plug to protrude through either the top surface or the bottom surface of the modular jack when the plug is inserted into the receptacle.

13. The card edge connector as in claim 12, wherein the printed circuit board engaging portion of the contact pin extends across an upper surface of a top wall of the socket.

14. The card edge connector as in claim 13, further comprising a groove in the upper surface of the top wall of the socket; wherein a portion of the printed circuit board engaging portion of the contact pin is disposed within the groove.

15. The card edge connector as in claim 12, further comprising at least one slot in the connector, at least a portion of the slot positioned between the rear wall of the modular jack and a distal end of the connector, wherein a portion of the contact pin is disposed within the slot.

16. The card edge connector as in claim 15, further comprising a groove in the upper surface of the top wall of the socket, the groove being generally aligned with the at least one slot in the connector.

17. A card edge connector that allows a modular jack to be removably attached to a communications card that conforms to the PCMCIA requirements for a PC card, the card edge connector comprising:

a housing including an upper surface and a lower surface that are separated by a distance of 10.5 mm or less;

a receptacle located in a front wall of the housing that is sized and configured to receive a RJ series connector plug along a generally longitudinal axis such that no portion of the plug extends through either the upper surface or the lower surface of the housing when the plug is inserted into the receptacle;

a connector attached to a rear wall of the housing and including a receiving portion that is sized and configured to removably receive an edge of a circuit board; and a contact pin including a first portion that is disposed in the receptacle and configured to be electronically connected to the RJ series connector plug when the plug is inserted into the receptacle, and a second portion that is disposed in the receiving portion of the connector and configured to be electronically connected to the circuit board when the circuit board is inserted into the connector;

wherein there is no cutout that is configured to allow a biased clip of the RJ series connector plug to protrude through either the upper surface or the lower surface of the housing when the plug is inserted into the receptacle.

18. A card edge connector for electrically connecting a jack to a circuit board disposed within a communications card, the card edge connector comprising:

a housing including an upper surface and a lower surface that are separated by a distance of 10.5 mm or less;

a receptacle located in a front wall of the housing that is sized and configured to receive a RJ series connector plug along a generally longitudinal axis such that no portion of the plug extends through either the upper surface or the lower surface of the housing when the plug is inserted into the receptacle;

a rearwardly extending connector attached to a rear surface of the housing; and a receiving portion disposed in the rearwardly extending connector that is sized and configured to removably receive an edge of the circuit board;

wherein there is no cutout that is configured to allow a biased clip of the RJ series connector plug to protrude through either the upper surface or the lower surface of the housing when the plug is inserted into the receptacle.

19. The card edge connector as in claim 18, further comprising a contact pin including a first portion that is disposed in the receptacle and configured to be electronically connected to the RJ series connector plug when the plug is inserted into the receptacle, and a second portion that is disposed in the, receiving portion of the connector and configured to be electronically connected to the circuit board when the circuit board is inserted into the connector.

20. The card edge connector as in claim 19, further comprising a groove in the rearwardly extending connector that receives a portion of the contact pin.

21. The card edge connector as in claim 18, wherein the communication card complies with the requirements for a PCMCIA Type III card.

22. An apparatus that allows a RJ series connector plug to be connected to a communications card that complies with the PCMCIA Type III card standards, the apparatus comprising:

a housing including an upper surface, a lower surface, a front surface and a rear surface, the upper surface and the lower surface being separated by a distance of 10.5 mm or less;

a receptacle located in the front surface of the housing that is sized and configured to receive the RJ series connector plug along a generally longitudinal axis such that no portion of the plug extends through either the upper surface or the lower surface of the housing when the plug is inserted into the receptacle; and a connector extending from the rear surface of the housing that is sized and configured to receive an edge of the circuit boards wherein there is no cutout that is configured to allow a biased clip of the RJ series connector plug to protrude through either the upper surface or the lower surface of the housing when the plug is inserted into the receptacle.

23. The card edge connector as in claim 22, further comprising a contact pin including a first portion that is disposed in the receptacle and configured to be electronically connected to the RJ series connector plug when the plug is inserted into the receptacle, and a second portion that is disposed in the connector and configured to be electronically connected to the circuit board when the circuit board is inserted into the connector.

* * * * *

UNITED STATES PATENT AND TRADEMARK OFFICE

CERTIFICATE OF CORRECTION

PATENT NO. : 6,325,674 B1 
DATED : December 4, 2001
INVENTOR(S) : David Oliphant and Thomas A. Johnson It is certified that error appears in the above-identified patent and that said Letters Patent is hereby corrected as shown below:

Column 3,
Line 4, after "angle" change "a" to -- α --.

Column 4,
Line 20, before "Another" start a new paragraph

Column 6,
Line 49, after "communications" insert -- card; --

Column 7,
Line 25, before "FIG. 18" start a new paragraph

Column 8,
Line 31, after "jack 230 is" delete "the"

Column 14,
Line 20, before "nylon," insert -- as --
Line 51, before "entitled" insert -- filed March 20, 2000, --
Line 52, after "reference" change "it" to -- in --

Column 18,
Line 11, after "the" delete the comma
Line 38, after "circuit" change "boards" to -- board; --

Signed and Sealed this

Seventh Day of October, 2003

JAMES E. ROGAN
*Director of the United States Patent and Trademark Office*